US005456770A

United States Patent [19]

Sato et al.

[11] Patent Number: 5,456,770

[45] Date of Patent: Oct. 10, 1995

[54] AMORPHOUS MAGNETIC ALLOY WITH HIGH MAGNETIC FLUX DENSITY

[75] Inventors: Takashi Sato; Toshio Yamada; Masahiro Fujikura; Wataru Ohashi; Satoshi Yamashita, all of Kawasaki, all of Japan; Hideo Hagiwara, Asuncion, Paraguay

[73] Assignee: Nippon Steel Corporation, Tokyo, Japan

[21] Appl. No.: 286,246

[22] Filed: Aug. 8, 1994

Related U.S. Application Data

[63] Continuation of Ser. No. 920,863, Jul. 28, 1992, abandoned.

[30] Foreign Application Priority Data

| | | | |
|---|---|---|---|
| Jul. 30, 1991 | [JP] | Japan | 3-190392 |
| Jul. 30, 1991 | [JP] | Japan | 3-190393 |
| Sep. 26, 1991 | [JP] | Japan | 3-248094 |
| Oct. 22, 1991 | [JP] | Japan | 3-274324 |

[51] Int. Cl.[6] ..... H01F 1/153

[52] U.S. Cl. ..... 148/304; 148/305; 420/441; 420/452; 420/459; 420/58; 420/117; 420/119; 420/121

[58] Field of Search ..... 148/304, 305, 148/403; 420/435, 436, 440, 441, 452, 459, 589, 117, 119, 121

[56] References Cited

U.S. PATENT DOCUMENTS

| | | | |
|---|---|---|---|
| 3,856,513 | 12/1974 | Chen et al. | 148/403 |
| 4,187,128 | 2/1980 | Billings et al. | 148/304 |
| 4,188,211 | 2/1980 | Yamaguchi et al. | 148/304 |
| 4,221,257 | 9/1980 | Narasimhan | 164/87 |

FOREIGN PATENT DOCUMENTS

| | | | |
|---|---|---|---|
| 56-105453 | 8/1981 | Japan | 148/403 |
| 58-31053 | 2/1983 | Japan . | |
| 59-53650 | 3/1984 | Japan | 148/304 |
| 63-28483 | 6/1988 | Japan . | |

OTHER PUBLICATIONS

Fiedler et al., General Electric Technical Information Series No. 81CRD199 (Aug. 1981).

Fiedler et al., IEEE Transactions on Magnetics, vol. Mag.—18, No. 6, pp. 1388–1390 (1982).

Fujinami et al., Journal of Non–Crystalline Solids, 69, pp. 361–369 (1985).

*Primary Examiner*—John P. Sheehan

*Attorney, Agent, or Firm*—Wenderoth, Lind & Ponack

[57] ABSTRACT

An amorphous magnetic alloy of a composition represented by $Fe_aSi_bB_cSn_x$, where $60<a\leqq 90$, $1\leqq b\leqq 19$, $6\leqq c\leqq 20$, $0.01\leqq x<10$ (atomic %) and a+b+c+x=100.

2 Claims, 9 Drawing Sheets

FIG. 3(a)
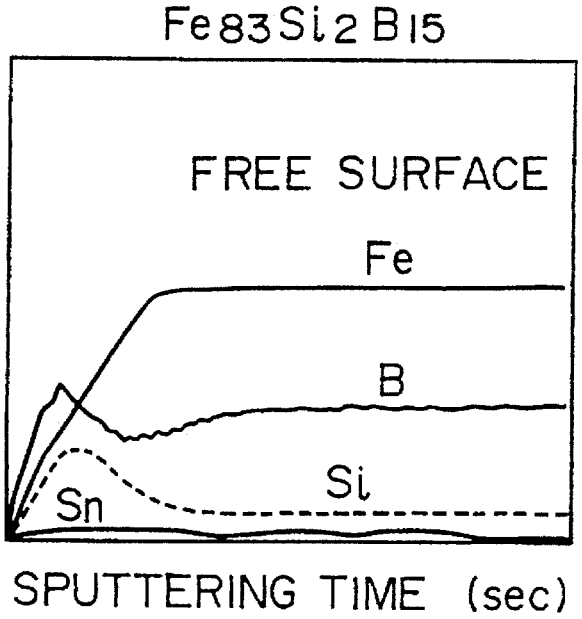
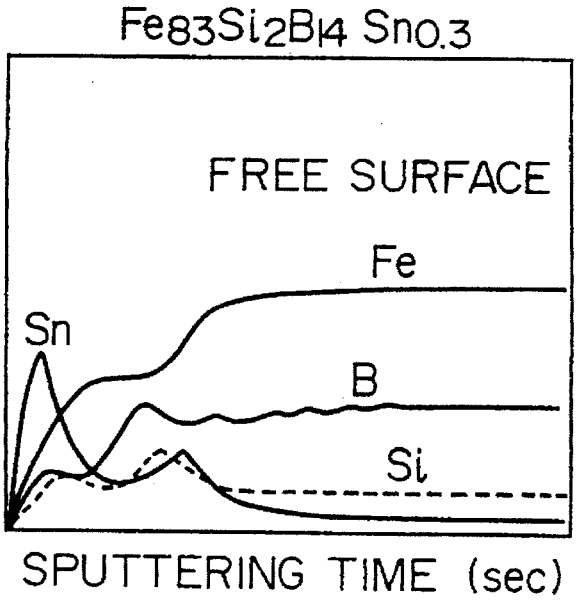
FIG. 3(b)

FIG. 9(a)
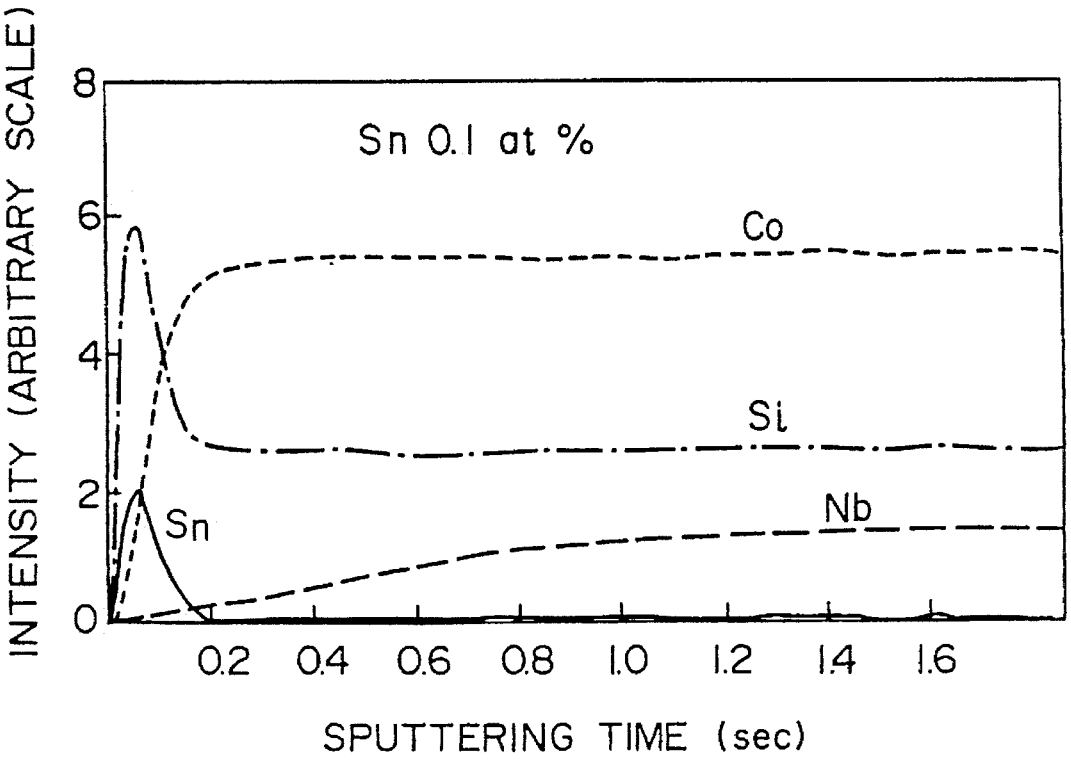
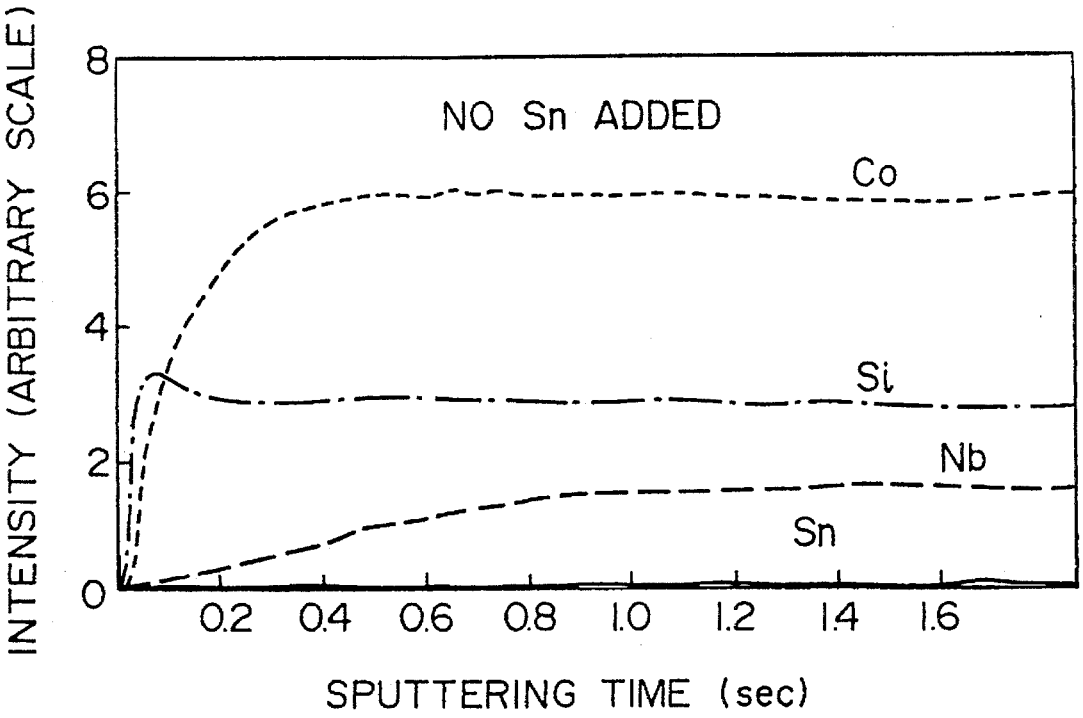
FIG. 9(b)

AMORPHOUS MAGNETIC ALLOY WITH HIGH MAGNETIC FLUX DENSITY

This application is a continuation of now abandoned application Ser. No. 07/920,863, filed Jul. 28, 1992, now abandoned.

BACKGROUND OF THE INVENTION

1. Field of the Invention

This invention relates to an amorphous magnetic alloy with high magnetic flux density intended for use mainly as the magnetic core material for power transformers but also suitable for use as the magnetic core material of saturable reactors, high-frequency transformers, smoothing chokes and other equipment requiring high saturation magnetic flux density and low loss.

2. Description of the Prior Art

As iron base amorphous alloys produced by the liquid quenching method are characterized by extremely low core loss, they have been seen as promising magnetic core materials for power transformers and high-frequency transformers. Nonetheless, they have as yet failed to achieve full-scale practical utilization. The reason for this lies in the fact that their saturation magnetic flux density is considerably lower than that of silicon steel sheet and the fact that they require expensive B as an indispensable alloying element.

The amorphous alloys that have so far been developed and practically applied in power transformers are Fe—Si—B alloys comprising about 78 atomic % Fe and 10 atomic % B. In these alloys top priority is not on saturation magnetic flux density but on amorphous phase formability and thermal stability. They therefore have the disadvantage of somewhat low saturation magnetic flux density (Bs<1.6T at room temperature). As use of a material with a low saturation magnetic flux density makes it necessary to set a low maximum operating magnetic flux density, the core becomes large in volume and weight.

An Fe-Si-B alloy is known to achieve a peak room-temperature saturation magnetic flux of about 1.68T when the Fe content is 82–83 atomic %. One conceivable approach to increasing the saturation magnetic flux density is therefore by increasing the alloy Fe content. This is not practical, however, because in the case of producing wide or thick materials which cool slowly it is difficult to achieve stable formation of ribbon composed solely of amorphous phase and including no crystalline phase. Owing to this, formation of crystalline phase is readily caused by even slight variations in the casting conditions, with the result that the product is degraded or becomes nonuniform in such soft magnetic properties as core loss and permeability. Simply stated, it has not been possible to realize a major improvement in the saturation magnetic flux density of Fe—Si—B alloys without degrading their soft magnetic properties.

Amorphous alloys have higher electrical resistance than conventional soft magnetic metals and are therefore easy to fabricate as thin materials. This means that the advantage of using an amorphous alloy increases with increasing frequency of the application. A notable example of this can be seen in Co base amorphous alloys which exhibit close to zero magnetostriction and also have a small coercive force Hc, properties that have led to practical application in magnetic amplifiers and common mode chokes.

All presently known zero-magnetostriction Co base amorphous alloys have been realized by including various auxiliary elements in the basic CoFeSiB alloy first announced by Kikuchi et al. Typical of these are the alloys disclosed in JP-A-58-31053 and JP-B-63-28483. JP-A-58-31053 relates to the improvement of thermal stability by addition of Ti, V, Cr, Mn, Ni, Zr, Nb, Mo, Ru, Hf, Ta, W and Re to the CoFeSiB alloy, and JP-B-63-28483 to a method for manufacturing a core with a high squareness ratio by annealing a toroidal core of amorphous CoXSiB alloy ribbon in a magnetic field parallel to the periphery thereof, X standing for one or more of Ti, V, Cr, Mn, Ni, Zr, Nb, Mo, Ru, Hf, Ta, W, Re, Fe, Y, Ce, Pr, Nd, Sm, Eu, Gd, Tb and Dy.

There are also various other requirements regarding practical constituents. Such other requisites include, for example, that the immunity to influence from lot-to-lot component variation be high, that the range of annealing conditions be broad, that degradation during the core fabrication process be low, and that the anti-corrosion property be excellent. When all of these additional factors are taken into consideration, it becomes clear that the alloys that have been proposed up to now leave much to be desired.

SUMMARY OF THE INVENTION

One object of this invention is to provide an Fe base amorphous magnetic alloy with high saturation magnetic flux density which experiences little degradation of core loss property and excitation property in wide or thick materials that exhibit a slow cooling rate during ribbon formation.

Another object of the invention is to provide an amorphous magnetic alloy ribbon which retains the superior properties and thermal stability of the amorphous magnetic alloy.

BRIEF DESCRIPTION OF THE DRAWINGS

FIGS. 3(*a*) and 3(*b*) are graphs showing the main element profiles in the depth direction from the free surface of ribbon as observed by glow discharge spectrometry (GDS), (a) showing the profiles in a ribbon with no added Sn and (b) the profiles in a ribbon with added Sn.

FIGS. 9(*a*) and 9(*b*) are graphs comparing principal element concentration with depth from the surface as observed by glow discharge spectrometry (GDS), (a) relating to an invention amorphous alloy with added Sn and (b) to a conventional amorphous alloy without added Sn.

DETAILED DESCRIPTION OF THE INVENTION

This invention concerns an amorphous magnetic alloy ribbon composed of $Fe_aSi_bB_cSn_x$, manufactured by the single-side cooling method, exhibiting high saturation magnetic flux density and intended for use in transformers. The subscripts a, b, c and x indicate atomic percent and satisfy the relationships:

$$60<a\leqq,\ 1\leqq b\leqq,\ 6\leqq c\leqq,\ 0.01\leqq x\leqq.0,\ a+b+c+x=.$$

Moreover, up to 20 atomic % of the Fe can be replaced by Co and/or up to 10 atomic % of the Fe can be replaced by Ni.

Since the amorphous Fe—Si—B alloy ribbon according to the invention contains a small amount of Sn, it has a high saturation magnetic flux density and retains its excellent soft magnetic properties of low core loss and high permeability even in wide and thick materials. In addition, the amount of variation in these magnetic properties is small both within one and the same lot and between different lots. Furthermore, the annealing conditions for the ribbon can be freely selected within a broad range.

Therefore, when the amorphous magnetic alloy according to the invention is used as a magnetic core material for power transformers, saturable cores, high-frequency transformers or any of various other types of equipment requiring a core with high saturation magnetic flux density, it makes it possible to realize a core which is both compact in size and stable in its properties. In addition, the amorphous magnetic alloy is also superior to conventional materials when used in magnetic shield materials and magnetic sensors.

The invention will now be explained with reference to its different aspects.

First Aspect of the Invention

The amorphous magnetic alloy ribbon according to the first aspect of the invention is manufactured by the single-side cooling method and has a composition represented by $Fe_aSi_bB_cSn_x$, where a, b, c and x indicate atomic percent and $81<a\leqq86$, $1\leqq b\leqq12$, $6\leqq c\leqq16$, $0.05\leqq x<1$ and $a+b+c+x=100$.

Figure 1:
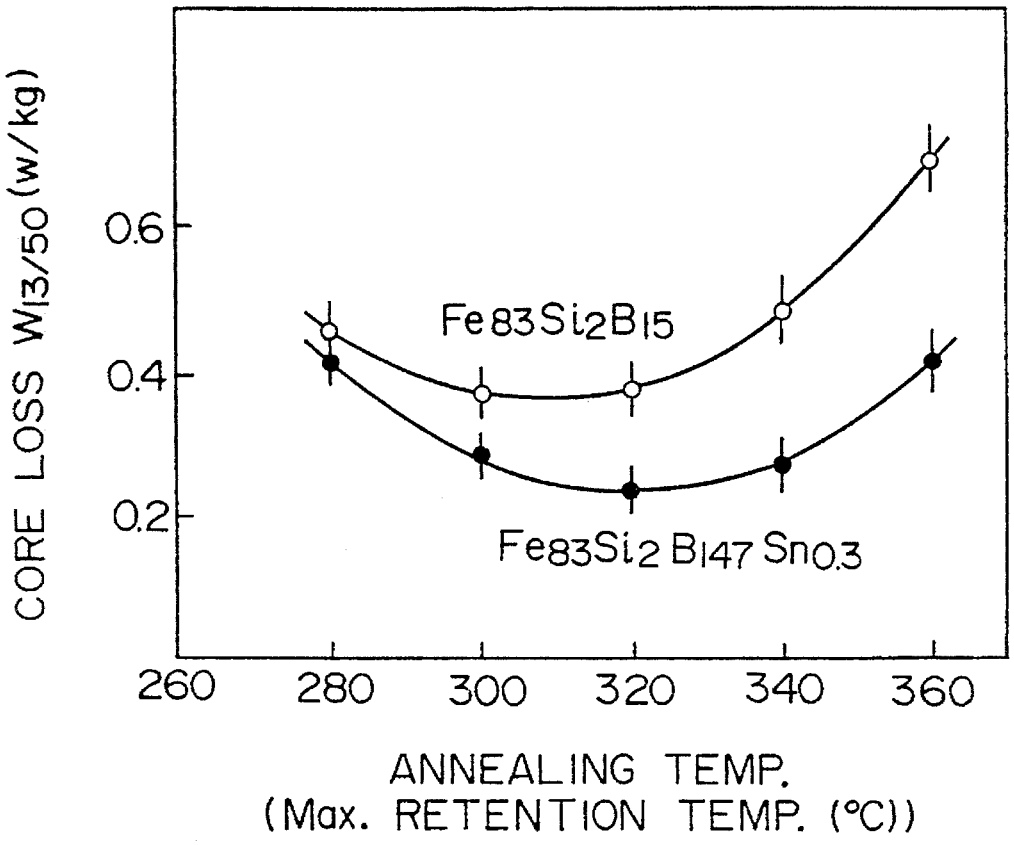
FIG. 1 is a graph showing the effect of adding Sn to an Fe—Si—B amorphous alloy with a high Fe content.

FIG. 1 shows the effect of Sn addition on magnetic property after annealing of a 25 mm wide, approximately 30 μm thick Fe—Si—B amorphous alloy ribbon manufactured by the single roll quenching method. As can be seen in this figure, ribbon added with Sn not only exhibits superior magnetic property for the same annealing temperature but also has a wider range of annealing temperatures over which it achieves good magnetic properties. As will be explained further below, it is believed that this result of Sn addition comes from the effect of Sn in suppressing surface crystallization.

Figure 2:
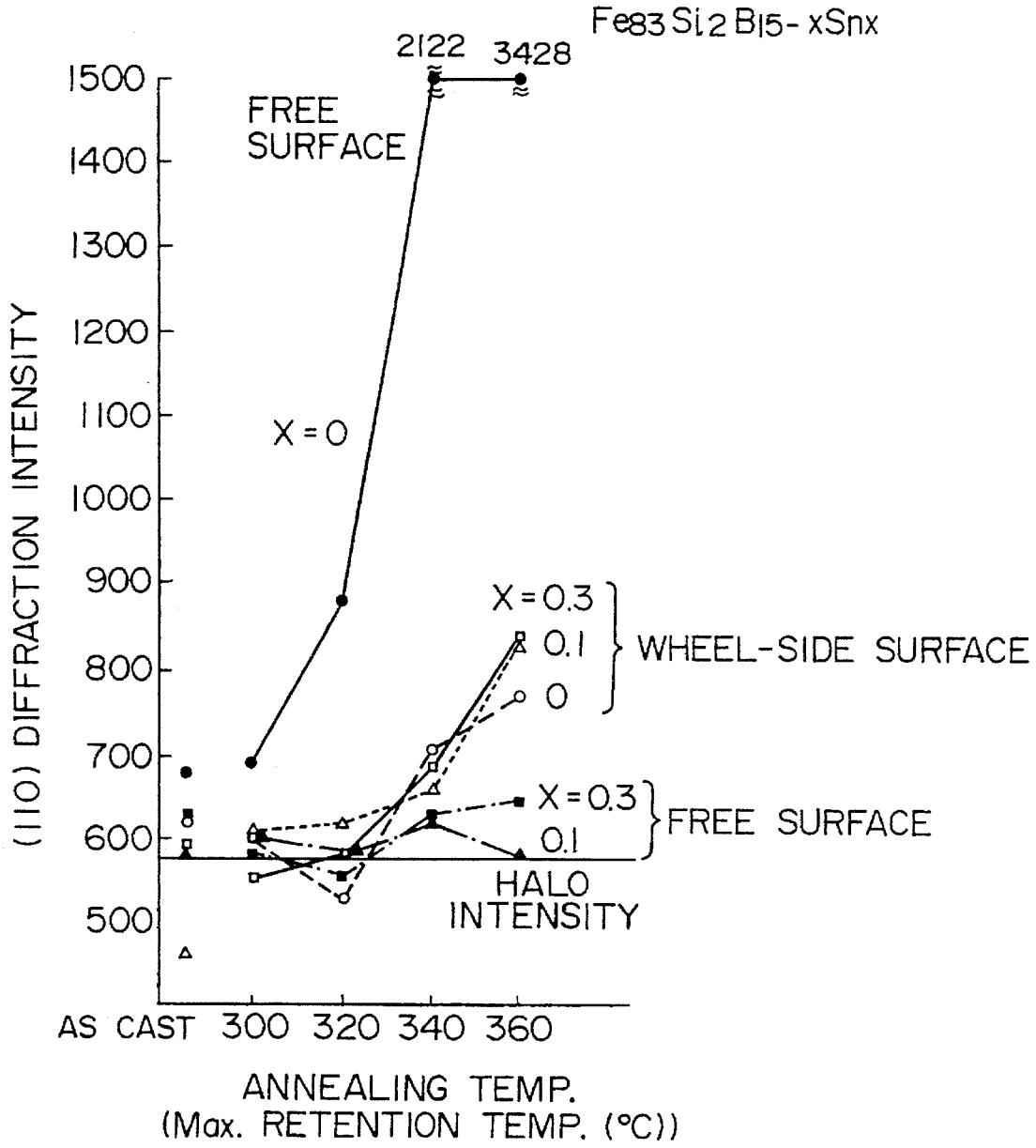
FIG. 2 is a graph showing the amorphous properties of an Fe—Si—B amorphous alloy ribbon with a high Fe content as determined by X-ray diffraction analysis.

FIG. 2 shows the (110) plane X-ray diffraction intensity measured for both sides of the Fe—Si—B amorphous alloy ribbons of FIG. 1. Ribbon not containing Sn had poor magnetic properties and exhibited a high, sharp crystallization peak on the free side (side that was not in contact with the casting roll). The peak rises in the direction of increasing annealing temperature. On the other hand, the Sn-containing ribbons exhibited good magnetic property and substantially maintained a low crystallization intensity pattern. It will be noted that on the roll-side surface there was no clear difference between the cases where Sn was and was not added. From this, it is thought that the improvement by addition of Sn derives from the effect of Sn in suppressing crystallization on the free side of the ribbon.

The reason for the limitations on the content ranges of the alloy elements will now be explained.

As stated above, Sn is an indispensable constituent for suppressing crystallization on the free surface of the ribbon. This crystallization suppressing effect is not manifested at a Sn content of less than 0.05 atomic % while at a Sn content of 1 atomic % or greater, the saturation magnetic flux density decreases and the ribbon formability is lost (an amorphous phase is not formed). The Sn content is therefore defined as not less than 0.05 atomic % and less than 1 atomic %.

The reason for the limitations on the contents a, b and c of Fe, Si and B will now be explained.

For meeting the condition of a high saturation magnetic flux density (of not less than 1.63 tesla), a is defined as over 81 to 86 (atomic %; hereinafter the same), preferably 82–85. When a falls below the lower limit of this range, it is difficult to achieve a saturation magnetic flux density of 1.63T or greater. When it exceeds the upper limit of the range, formation of the amorphous phase becomes difficult and the magnetic properties become nonuniform to a considerable degree.

Si and B are added for improving amorphous phase formability and thermal stability. In the first aspect of the invention, b is defined as 1–12, preferably 1–9, and c as 6–16, preferably 7–below 15. When b is below 1 or c is below 6, amorphous phase is not formed stably. On the other hand, b in excess of 12 or c in excess of 16 only increases the raw material costs and does not contribute to improvement of the amorphous phase formability or the thermal stability. Therefore, b is limited to the range of 1–12 and c to the range of 6–16.

The mechanism by which Sn suppresses crystallization on the free surface of an amorphous alloy ribbon of Fe—Si—B alloy has not yet been clarified. However, when glow discharge spectrometry is applied for analyzing the surfaces of alloy ribbons containing and not containing Sn, it is found that, as shown in FIGS. 3(*a*) and 3(*b*), segregation of Sn on the free surface is more pronounced in the case of an Sn content of 0.3 atomic % (FIG. 3(*a*)) than in the case of no Sn addition (FIG. 3(*b*)) and also that the addition of Sn modifies the distribution state of the Fe, Si and B which are indispensable for amorphous phase formation. From this it can be surmised that Sn contributes to stabilization by protecting the unstable surface layer of the ribbon from crystallization. The inventors succeeded in stabilizing ordinarily unstable high-Fe amorphous alloy by applying to this alloy the knowledge they acquired through their research regarding the effect of Sn in suppressing crystallization of the surface of amorphous alloy ribbon.

A working method for the first aspect of the invention will now be explained.

First, a blend of raw material or a mother alloy constituted so as to obtain a composition containing Fe, Si, B and Sn in amounts falling within the ranges prescribed above is melted. At this time, there may be included elements other than the four elements mentioned insofar as they are added within a range that does not degrade the high saturation magnetic flux density and low core loss property aimed at by the first aspect of the invention. Specifically, such additional elements can be added at up to 2 atomic %. Elements appropriate for addition include V, Mn, Mo, Nb, Ta, W, Cr and Hf. These elements are known to be effective for improving permeability, anticorrosion property and thermal stability.

In addition, Fe can be replaced by up to 20 atomic % of Co and with up to 10 atomic % of Ni, based on the total amount of the alloy. Within these ranges, Co works to improve the saturation magnetic flux density and Ni works to maintain the saturation magnetic flux density and improve the core loss property and permeability.

The alloy melt is ordinarily formed into a quenched ribbon by a single-side cooling method such as the single roll quenching method. The nozzle used can be a single-slit nozzle or a multiple-slit nozzle. The single-slit nozzle has a long, narrow slit opening measuring 0.2–1.0 mm in the direction of substrate travel and is used for producing ribbon with a thickness not exceeding 40 μm. The multiple-slit nozzle has a plurality of slit openings spaced at a prescribed pitch (ordinarily 1 mm–4 mm) in the direction of substrate travel and is used for producing materials with a thickness of 45 μm or more. The casting atmosphere can be atmospheric air, an inert gas or a vacuum.

The amorphous alloy ribbon produced in the aforesaid manner exhibits high saturation magnetic flux density (at least 1.63T at room temperature). Moreover, no generation of crystal phase is observed on the free surface even in thick materials (40 μm and greater). As a result, the ribbon has a low core loss value and little variation in properties. Ribbon produced to an ordinary thickness of under 40 μm also exhibits a pronounced improvement in core loss property and property uniformity.

The amorphous magnetic alloy ribbon according to the first aspect of invention is used for fabricating magnetic cores and can be applied in either of the two main types of cores, wound and laminated. Once the core has been formed, it is heat treated for alleviating strain. In the first aspect of the invention, the maximum temperature of the heat treatment is set between 260° C. and 350° C. and the ribbon is held at this temperature for not less than 1 minute but less than 30 minutes. The reason for these heat treatment conditions is that the strain is not adequately relieved if the treatment temperature is below 260° C. or the retention time is less than 1 minute, whereas crystallization starts if the temperature exceeds 350° C. or the retention time is 30 minutes or longer.

Second Aspect of the Invention

The amorphous magnetic alloy ribbon according to the second aspect of the invention is manufactured by the single-side cooling method and has a composition represented by $(Fe_aSi_bB_cC_d)_{100-x})Sn_x$, where a, b, c and d indicate atomic percent and a=0.80–0.86, b=0.01–0.12, c=0.06–0.16, d=0.001–0.04, a+b+c+d=1, and x=0.05–1.0.

The preferable ranges are a=0.82–0.85, b=0.01–0.09, c=0.07–under 0.10, d=0.001–0.04, a+b+c+d=1, and x=0.05–1.0 (atomic %).

In this manner, by adding a small amount of Sn to an Fe—Si—B—C alloy with a high Fe content, it is possible to obtain an amorphous alloy ribbon for transformer cores which achieves a high saturation magnetic flux density while stably retaining the amorphous phase formability, core loss property and excitation property of the alloy.

Figure 4:
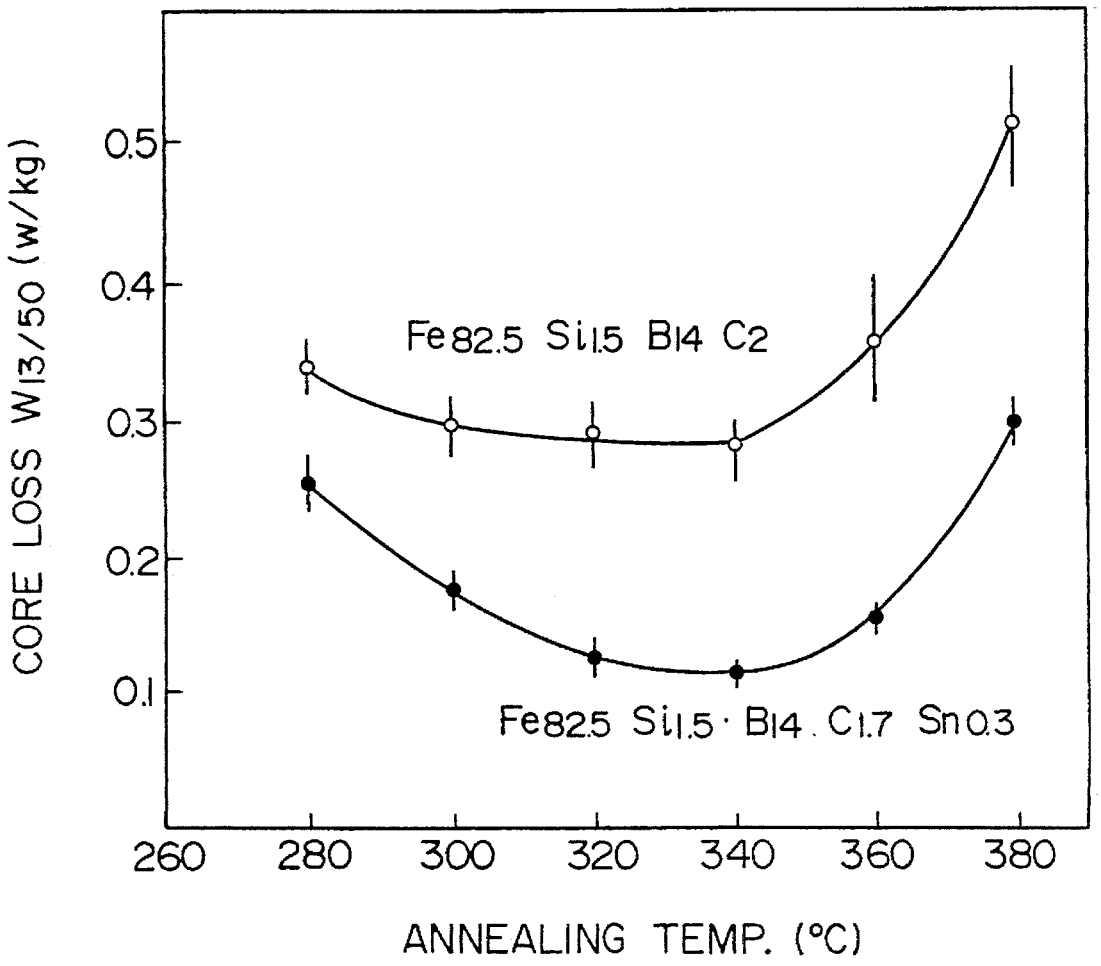
FIG. 4 is a graph showing the effect of adding Sn to an Fe—Si—B—C amorphous alloy with a high Fe content.

FIG. 4 shows the effect of Sn addition on the magnetic property of 25 mm ×120 mm ×35 μm Fe—Si—B—C amorphous alloy ribbon manufactured by the single-roll quenching method and annealed for 45 minutes under application of a 30 oersted magnetic field. As can be seen from this graph, ribbon containing Sn not only exhibits superior magnetic property for the same annealing temperature but also exhibits greater property uniformity. In addition, good magnetic property is exhibited over a broad annealing temperature range. This improvement by addition of Sn is thought to derive from the effect of Sn in suppressing surface crystallization.

Figure 5:
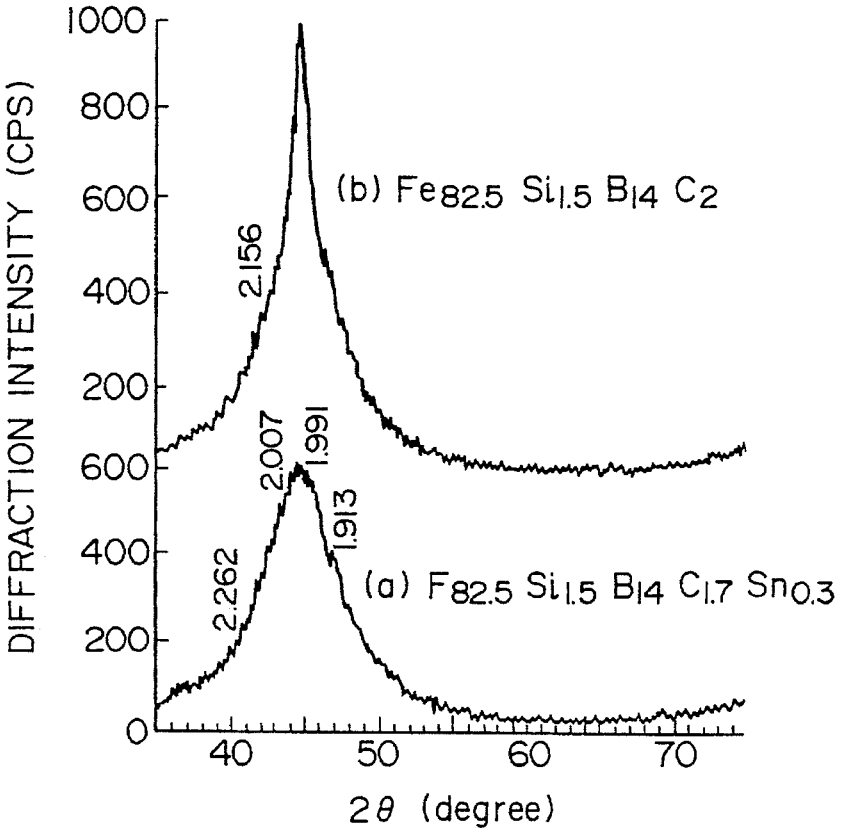
FIG. 5 is a graph showing the X-ray patterns of Fe—Si—B—C amorphous alloy ribbon with a high Fe content, with and without addition of Sn, after annealing at 320° C.

FIG. 5 shows the X-ray diffraction pattern of the Fe—Si—B—C amorphous alloy of FIG. 4. As can be seen from curve (b), Sn-free ribbon with poor magnetic property exhibited a high, sharp crystallization peak on the free side. In contrast, as shown by curve (b), Sn-containing ribbon with superior magnetic property maintained the halo intensity pattern without substantial modification. On the roll-side surface there was no clear difference between the cases where Sn was and was not added. From this, it is thought that the improvement by addition of Sn derives from the effect of Sn in suppressing crystallization on the free side of the ribbon. Sn addition is particularly effective in Fe—Si—B—C alloy.

The reason for adding C to Fe—Si—B alloy has generally been for improvement of melt flowability and of wettability with respect to a cooling substrate made of copper or the like. Improving wettability substantially enhances cooling capability, which in turn makes it easier to obtain the high Fe content alloy in amorphous phase. On the other hand, it is known that C promotes surface layer crystallization in amorphous alloy ribbon. While C induced surface layer crystallization is not as harmful as that known to be caused by Al, it nevertheless cannot be ignored in alloys with an Fe content of 82 atomic % or higher. The inventors developed an amorphous magnetic alloy which retains the high saturation magnetic flux density, core loss property and permeability of the Fe—Si—B—C alloy by applying to this alloy the knowledge they acquired through their research regarding the effect of Sn in suppressing surface crystallization.

The reason for the limitations on the content ranges of the alloy elements will now be explained.

As was mentioned earlier, Sn is an indispensable constituent for suppressing crystallization on the free surface of the ribbon. This crystallization suppressing effect is not manifested at a Sn content of less than 0.05 atomic % while at a Sn content of 1 atomic % or greater, the saturation magnetic flux density decreases and the ribbon formability is lost (an amorphous phase is not formed). The Sn content is therefore defined as 0.05–1 atomic %.

The reason for the limitations on the values of a, b, c and d in $Fe_aSi_bB_cC_d$ will now be explained.

For meeting the condition of a high saturation magnetic flux density (of not less than 1.63 tesla), a is defined as over 0.80 to 0.86, preferably 0.82–0.85. When a falls below the lower limit of this range, it is difficult to achieve a saturation magnetic flux density of 1.63T or greater. When it exceeds the upper limit of the range, formation of the amorphous phase becomes difficult and the magnetic properties become nonuniform to a considerable degree.

Si and B are added for improving amorphous phase formability and thermal stability. In the second aspect of the invention, b is defined as 0.01–0.12, preferably 0.01–0.09, and c as 0.06–0.16, preferably 0.07–below 0.10. When b is below 0.01 or c is below 0.06, amorphous phase is not formed stably. On the other hand, b in excess of 0.12 or c in excess of 0.16 only increases the raw material costs and does not contribute to improvement of the amorphous phase formability or the thermal stability. Therefore, b is limited to the range of 0.01–0.12 and c to the range of 0.06–0.16.

C is an element required for improving the productivity of the amorphous magnetic alloy ribbon. Addition of C improves wettability with respect to the Cu or the like from which the cooling substrate is formed, enabling formation of ribbon with good properties. This effect of C is particularly pronounced in an alloy with a high Fe content. However, a value of d below 0.001 does not produce any improvement in wettability with the cooling substrate, while one of over 0.04 degrades the thermal stability and promotes crystallization of the ribbon surface layer. Therefore, d is defined as falling within the range of 0.001–0.04.

In addition, the alloy according to the second aspect of the invention can further include the other elements within a range that does not degrade the high saturation magnetic flux density and low core loss property aimed at by the second aspect of the invention. Specifically, it can include one or more of V, Mn, Mo, Nb, Ta, W, Cr and Hf in a total amount not exceeding 2 atomic %. Addition of these elements is known to be effective for improving permeability, anticorrosion property and thermal stability. In addition, Fe can be replaced by up to 20 atomic % of Co and/or with up to 10 atomic % of Ni. Co is effective for improving the saturation magnetic flux density and Ni for enhancing the soft magnetic properties.

Figure 6A:
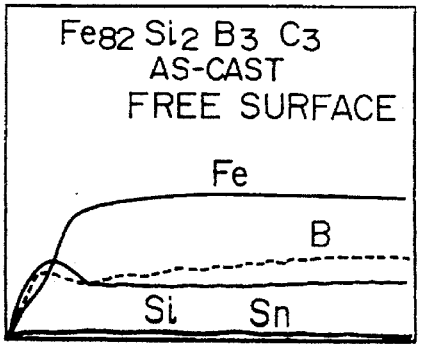
FIGS. 6(*a*) and 6(*b*) are graphs showing the main element profiles in the depth direction from the free surface of ribbon as observed by glow discharge spectrometry (GDS), (a) showing the profiles in a ribbon with no added Sn and (b) the profiles in a ribbon with added Sn.
Figure 6B:
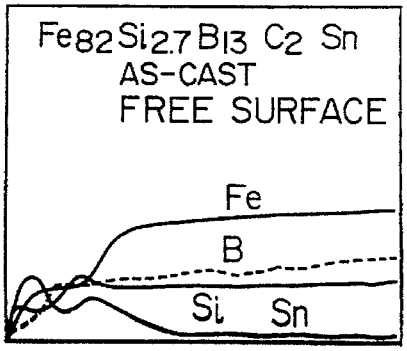

The mechanism by which Sn suppresses crystallization on the free surface of an amorphous alloy ribbon of Fe—Si—B—C alloy has not yet been clarified. However, when the surface of the Sn-containing ribbon according to this aspect of the invention is analyzed by glow discharge spectrometry it is found that, as shown in FIG. 6(*b*), the concentration of Sn segregation on the free surface is pronounced and also that the addition of Sn modifies the distribution state of the Fe, Si and B which are indispensable for amorphous phase formation. The difference with respect to the case of ribbon not containing Sn, shown in FIG. 6(*b*), is considerable. From this it can be surmised that Sn contributes to stabilization by protecting the unstable surface layer of the ribbon from crystallization. This effect of Sn is particularly pronounced in the Fe—Si—B alloy containing C according to the second aspect of the invention.

As was stated earlier, by its effect of improving wettability with the substrate material, C contributes to upgrading the shape, amorphous property and mechanical properties of the amorphous alloy ribbon. However, addition of an excessive amount of C degrades thermal stability and promotes crystallization of the ribbon surface during annealing. The effect of adding Sn to a C-containing Fe—Si—B alloy with these strong and weak points is especially great because the Sn particularly works to mitigate the weak point.

The inventors succeeded in stabilizing C-containing, high-Fe amorphous alloy, an alloy up to now considered to be unstable, by applying to this alloy the knowledge they acquired through their research regarding the effect of Sn in suppressing crystallization of the surface of amorphous alloy ribbon.

In the second aspect of the invention, a blend of raw material or a mother alloy constituted so as to obtain a composition containing Fe, Si, B, C and Sn in amounts falling within the ranges prescribed above is melted and the melt is used for producing a quenched amorphous alloy ribbon by in accordance with the working method explained with regard to the first aspect of the invention.

The amorphous alloy ribbon produced in the aforesaid manner exhibits high saturation magnetic flux density (at least 1.63T at room temperature). Moreover, no generation of crystal phase is observed on the free surface even in wide, thick materials measuring 20 mm or more in width and 40 μm or more in thickness. As a result, the ribbon has a low core loss value and little variation in properties. Ribbon produced to an ordinary thickness of under 40 μm also exhibits a pronounced improvement in core loss property and property uniformity.

Third Aspect of the Invention

The amorphous magnetic alloy ribbon according to the third aspect of the invention is manufactured by the single-side cooling method, has a composition represented by $M_aX_bSi_dB_cC_e$ and contains 0.01–1.0 weight % of Sn based on this composition. The surface layer of the ribbon extending to a depth of not more than 0.1 μm from the surface includes a Sn segregation layer measuring 0.03 μm or less in thickness and having a peak Sn concentration that is five or more times that of the ribbon bulk. This segregation layer enhances resistance to crystallization. In the aforesaid composition, M represents at least one of Fe, Co and Ni, X represents at least one of Mo, Nb, Ta, W, Cr, V, Mn and Cu, a=60–90 (atomic %; hereinafter the same), b=0–6, c=1–19, d=7–20, e=0–4, and a+b+c+d+e=100.

An amorphous alloy crystallizes when heated to or above its crystallization temperature. However, the crystallization does not proceed simultaneously at all parts of the alloy but starts from the ribbon surface. This has been reported by H. C. Fiedler et al. in General Electric Report No. 81, 81 CRD 199 (1981). In the case of a ribbon manufactured by the single-side cooling method, the crystallization starts from the free side. This is thought to be because the cooling rate is slower on the free side than on the roll side. On either the free side or the roll side the crystallization onset temperature is considerably lower than the crystallization temperature of the amorphous alloy. Fujinami et al. investigated the crystallization behavior of Fe—Si—B—C amorphous alloy using Mössbaure spectrometry and found that crystallization of the surface layer starts at a temperature 50° C. lower than the theoretical crystallization temperature of the bulk obtained by differential analysis. (Journal of Non-Crystalline Solids Vol. 69, P361 (1985)).

The degradation of magnetic property observed in amorphous alloy ribbons notwithstanding that the ribbon temperature was kept considerably lower than the crystallization temperature of the bulk can be traced to this surface crystallization. This is taken up by H. C. Fiedler et al. in IEEE Trans. Mag 18 No. 6 (Nov. 1982). pp 1388–1390.

Owing to the crystallization of the surface layer at a temperature lower than that at the interior, the intrinsic properties of the amorphous alloy deteriorate at a temperature considerably lower than the crystallization temperature. The conventional method for preventing this has been to add several percent of an element which enhances thermal stability, thus modifying the make-up of the main components. The problem with this method is that it impairs the required properties other than thermal stability.

In the amorphous magnetic alloy according to the third aspect of the invention, a surface Sn segregation layer is formed which enables improvement of thermal stability without interfering with the realization of the other required properties. The method used for forming the surface Sn segregation layer is that of adding a small amount of Sn to the principal components. As the amount of Sn required to be added is only 0.01–1.0 weight % preferably 0.1–0.5 weight %, the added Sn has substantially no deleterious effect on the required properties provided by the principal components. To the contrary, it actually provides auxiliary beneficial effects of improving the magnetic properties and corrosion resistance.

The composition of the amorphous magnetic alloy will now be explained.

The principal components are represented by $M_aX_bSi_cB_dC_e$, where M stands for at least one of Fe, Co and Ni, X represents at least one of Mo, Nb, Ta, W, Cr, V, Mn and Cu, a=60–90 (atomic %; hereinafter the same), b=0–6, c=1–19, d=7–20, e=0–4, and a+b+c+d+e=100.

The Fe, Co, Ni content is selected within the range of 60–90 atomic % in accordance with the required properties. For example, if a magnetic material exhibiting a high magnetic flux density is required, Fe is selected as the principal component and 1–15 atomic % of the Fe is replaced by Co, Ni. When high permeability is required, Co is selected as the principal component and 1–10 atomic % of the Co is replaced by Fe and Ni.

The X element is added for property improvement and auxiliary effects. For instance, the specific purpose of the addition might be to increase the crystallization temperature of the bulk, improve the anticorrosion property, or enhance the mechanical properties. In the third aspect of the invention, X is limited to the range of 0–6 atomic %. The upper limit is set mainly in view of improvement effect and economic considerations.

The metalloids Si, B and C are indispensable elements for amorphous phase formation. Depending on the type and content of the aforesaid metal elements, they are added within the ranges of Si=1–19 (atomic %), B=7–20 (atomic %) and C=0–4 (atomic %). It is very difficult to obtain an amorphous material if the contents fall outside these ranges.

The crystallization-inhibiting, high-Sn segregation layer that characterizes the third aspect of the invention is formed within a surface layer extending to a depth of not more than 0.1 μm from the ribbon surface. Formation thereof at a greater depth causes the alloy to lose its inherent superior properties. The segregation layer has a thickness of not more than 0.03 μm. When it thicker, it again impairs the inherent superior properties of the alloy. The segregated Sn content has a peak value that is more than 5 times, preferably more than 10 times, that of the bulk (the ribbon interior). When the peak value of the segregated Sn content is less than 5 times that of the bulk, the segregation layer fails to provide sufficient resistance against crystallization. The state of the Sn segregation layer can be measured by various surface analysis methods. These include, for example, glow discharge spectrometry (GDS), Auger spectrometry and secondary ion mass spectrometry (SIMS).

Figure 7:
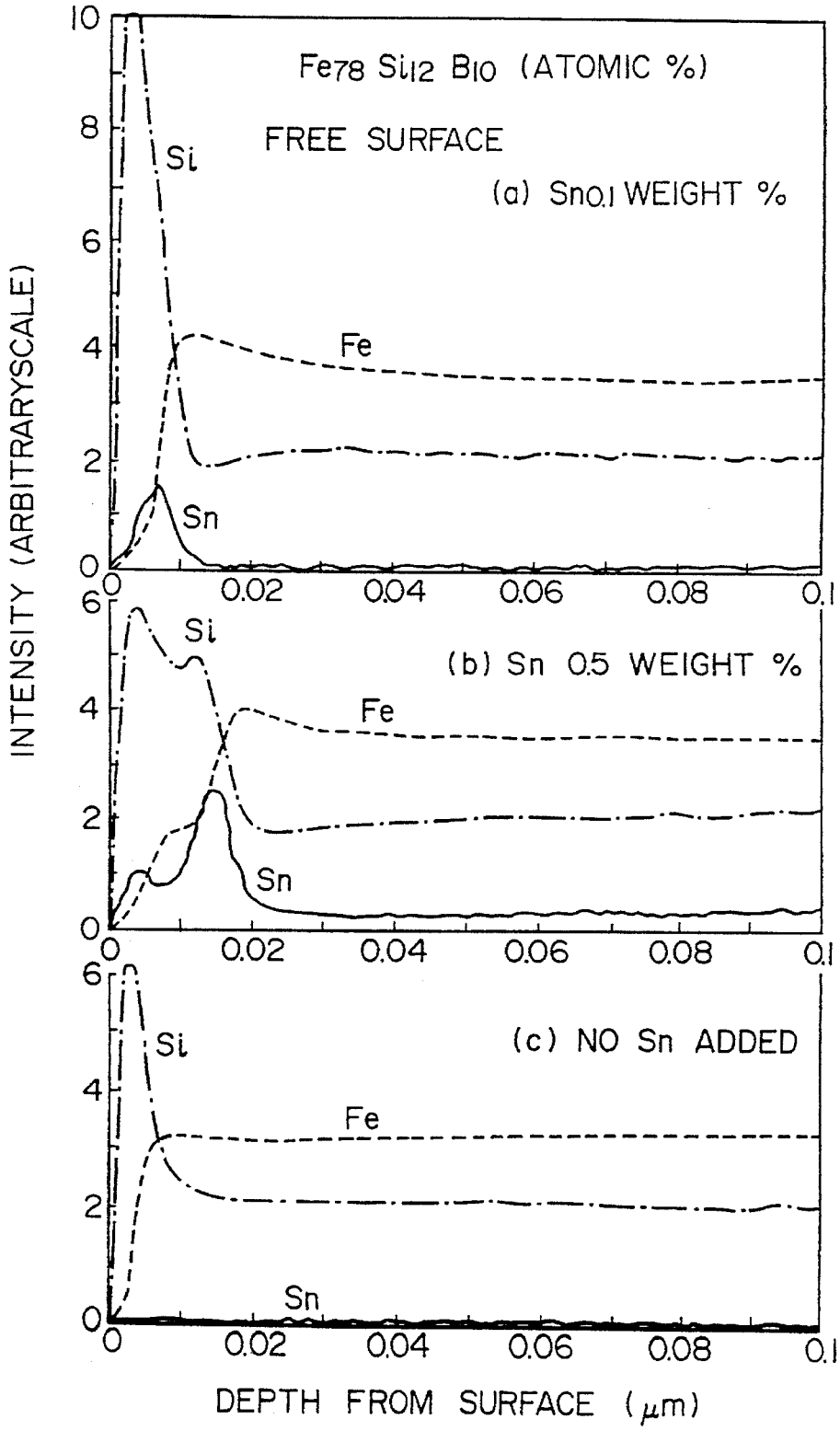
FIGS. 7 is graphs showing the concentration distributions of the principal elements in the depth direction from the surface of amorphous alloy ribbon, (a) and (b) relating to invention ribbons and (c) to a comparative example.

Amorphous magnetic alloys according to the third aspect of the invention were examined by GDS. The results obtained for surface analysis in the thickness direction are shown in FIG. 7(*a*) and FIG. 7(*b*) for invention alloys and in FIG. 7(*c*) for a comparative example. In each case the analysis was conducted in respect of the free surface of an $Fe_{78}Si_{12}B_{10}$ (atomic %) amorphous alloy ribbon. There are two types of Sn segregation layers, the Sn single-peak type shown in FIG. 7(*a*) and the multiple peak type shown in FIG. 7(*b*). FIG. 7(*c*) relates to a conventional alloy containing no Sn segregation. The distribution of the principal components can be seen to change in a manner related to the Sn segregation. In particular, when Si shifts toward the interior, the Fe distribution assumes a two-level pattern. While the mechanism by which the presence of the Sn segregation layer causes an increase in resistance to crystallization is still not clear, it is thought that a role is also played by the aforesaid modified state of the principal components, in addition to that of the Sn segregation layer itself.

The method of forming the concentrated Sn segregation layer according to the third aspect of the invention consists of quenching an alloy added with 0.01–1.0 weight % Sn by the single-side cooling method. The reason for stipulating the amount of Sn to be added is as follows. When Sn is present at less than 0.01 weight %, a segregation layer adequate for providing resistance to crystallization is not formed. When it is present in excess of 1.0 weight %, the Sn concentration of the bulk becomes too high, which deprives the principal components of their inherent superior properties. Even when Sn is added in an amount falling within the specified content range, variations occurring in production by the single-side cooling method may make impossible to form the Sn segregation layer specified by the third aspect of the invention. In such cases, an effective Sn segregation layer can be formed by holding the ribbon at 100°–300° C. for 0.5–1,000 hours (aging treatment).

While the third aspect of the invention has been explained with respect to using the known single roll quenching method as the single-side cooling method, it is also possible to use various other methods such as the belt method or the centrifugal quenching method. The amorphous magnetic alloy ribbon is produced by heating an alloy having the prescribed basic composition and added with Sn to above its melting point and then processing the resulting melt in accordance with the working method described with regard to the first aspect of the invention. This manufacturing method can also be applied for producing ribbon having a large width relative to its thickness as well as for producing film-like filaments. In addition, the invention can further be applied for manufacturing flake and powder amorphous metal material by jetting droplets onto a cooled substrate.

For use in certain applications, the quenched amorphous magnetic alloy according to the third aspect of the invention is subjected to heat treatment. While alloys have conventionally been heat treated at a temperature considerably lower than the crystallization temperature of the alloy bulk, the superior resistance to surface crystallization exhibited by the alloy according to the third aspect of the invention enables it to be heat treated at a higher temperature than has been possible heretofore. Since the residual strain following quenching can therefore be sufficiently relieved, much better magnetic properties can be obtained than has been possible in the past.

Fourth Aspect of the Invention

The amorphous magnetic alloy according to the fourth aspect of the invention has a composition represented by $Co_aFe_bNb_cSn_dSi_eB_f$ and exhibits superior soft magnetic characteristic at high frequency after heat treatment. In this composition, a=67–71 (atomic %; hereinafter the same), b=3–6, c=0.5–3.0, d=0.05–1.0, e=1–19, f=7–18, and a+b+c+d+e+f=100.

The alloy according to the fourth aspect of the invention is based on the known CoFeSiB alloy and is characterized by the combined addition of Nb and Sn to this alloy. The combined addition of Nb and Sn enables the improvement of soft magnetic properties, which is the main object of the invention, and also produces auxiliary effects. Specifically, it not only reduces high-frequency loss and coercive force in comparison with conventional compositions, it also improves practical properties that have been less then adequate in conventional alloys. For example, it makes it possible to realize (1) broader annealing condition tolerance, (2) reduced strain degradation, (3) improved corrosion resistance and (4) greater freedom in composition selection.

Figure 8A:
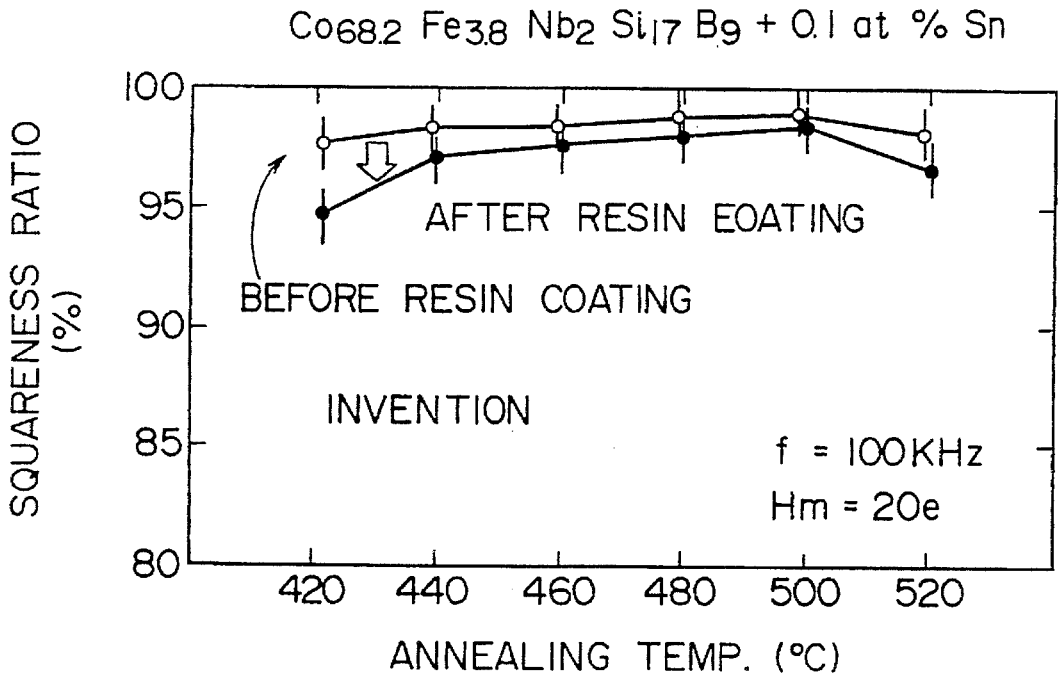
FIGS. 8(*a*) and 8(*b*) are graphs comparing annealing temperature dependence of a magnetic property (squareness ratio), (a) relating to an invention amorphous alloy with added Sn and (b) to a conventional amorphous alloy without added Sn.
Figure 8B:
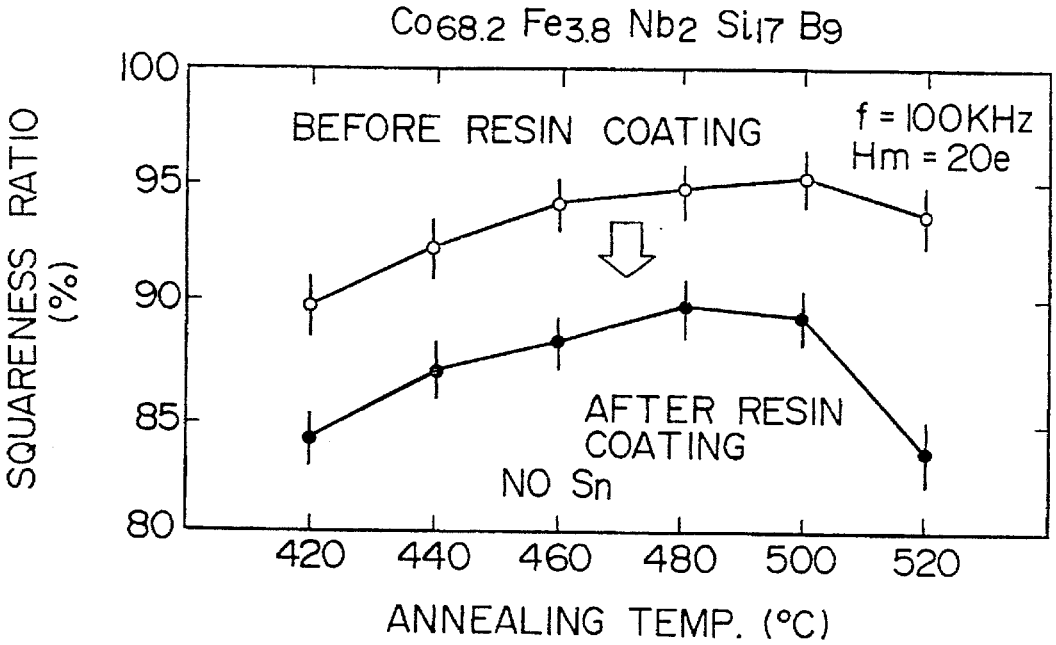

FIGS. 8(*a*) and 8(*b*) compare the annealing temperature dependency of magnetic properties in a Co base amorphous alloy without added tin (FIG. 8(*b*) and a Co base amorphous alloy with tin added according to the invention (FIG. 8(*a*). As can be seen from these graphs, in the case of the alloy without added Sn, the squareness ratio before resin coating (after annealing) exhibits strong sensitivity to change in annealing temperature and, moreover, the property degradation after resin coating (when strain is present) is large. In contrast, in the alloy according to the fourth aspect of the invention, the squareness ratio before resin coating exhibits excellent characteristics over a broad range of annealing temperatures and the property degradation after resin coating is small. Thus, practical properties which could not be brought up to a satisfactory level only by addition of Nb are further upgraded and production stability improved by the addition of Sn.

The improvement by addition of Sn is thought to derive from the effect of Sn in modifying surface properties. The basis for this belief is the phenomenon shown in FIG. 9(*a*) and 9(*b*) discovered by the inventors, namely that Sn and Si reach an extraordinarily high concentration in the surface layer of an amorphous alloy ribbon with added Sn. Specifically, it is thought that the reduction in high-frequency loss is attributable to the fact that the $SiO_2$ formed at the ribbon surface owing to the extraordinarily high level of Si segregation produces an increased insulating effect which suppresses interlayer eddy current loss. The improvement in corrosion resistance noted can be similarly explained. While the reason for the improvement in annealing tolerance and increased freedom in composition selection is not clear, the surface layer is presumed to play a role in this as well.

Nb increases the thermal stability and amorphous phase forming property of the amorphous alloy and in coexistence with Sn improves the magnetic properties of the alloy at high frequency. Use of Cr, Al, V and Zr, which have been reported as effective substitutes for Nb in the prior art, was not found to produce good results. This corroborates the fact that the combined presence of Nb and Sn is indispensable to achieving the object of the fourth aspect of the invention. Tests conducted by the inventors showed that the effect of Sn and Nb in combination was even greater than the combined effect of Sn and Mo. Moreover, while the preferable annealing temperature range for obtaining a squareness ratio of 95% or higher is 420°–480° C. when Sn and Mo are used in combination, this broadens to 440°–520° C. when Sn and Nb are used together. What is more, the coercive force of the invention alloy is 10% lower than that of an alloy containing Sn and Mo in combination. This means that the invention alloy can be used at higher frequency.

The reason for the limitations on the content ranges of the alloy elements will now be explained.

Sn is required for imparting the superior practical properties aimed at by the fourth aspect of the invention. Its content is specified as falling in the range of 0.05–1.0 atomic % because the Sn-induced modification of surface property that is a feature of the invention does not manifest itself strongly when Sn is present at either less than 0.05 atomic %, more than 1.0 atomic %.

The fourth aspect of the invention specifies Nb to be present in combination with Sn at a content of 0.5– 3.0 atomic %. Nb does not exhibit adequate effect at a content falling below 0.5 atomic % and lowers the saturation magnetic flux density at a content exceeding 3.0%.

The content ranges of Co, Fe, Si and B are fixed in view of the amounts of Sn and Nb added so as to meet the following conditions: (1) magnetostriction of not more than $10^{-6}$, (2) saturation magnetic flux density of not less than 0.4T, (3) alternating current magnetic properties at 100 kHz after core annealing in a magnetic field parallel to the core periphery satisfying at least the conditions of squareness ratio Br/Bs>0.90, preferably Br/Bm>0.95, and coercive force Hc<300 mOe, preferably Hc<200 mOe. Another condition set is that the initial permeability at 100 kHz after annealing in a perpendicularly applied magnetic field be at least 30,000. As composition conditions satisfying these conditions, the fourth aspect of the invention specifies a Co=67–71 atomic % Fe= 3–6 atomic % Si=1–19 atomic % and B=7–18 atomic %. When Co and Fe fall outside the specified ranges, the magnetostriction and saturation magnetic flux conditions are not met. On the other hand, when Si and B are outside the specified ranges, it becomes difficult to form an amorphous alloy and the prescribed alternating current magnetic property conditions cannot be satisfied.

The fourth aspect of the invention does not particularly specify the method for producing the amorphous magnetic alloy. Among others, it is possible to use the method explained with regard to the first aspect of the invention.

The amorphous magnetic alloy ribbon is annealed after being formed into a wound core of prescribed dimensions. In the past, before core fabrication, it has generally been the practice to provide the amorphous alloy ribbon with some kind of coating for insulating the laminated core sheets from each other. However, as the alloy according the fourth aspect of the invention already has a high-resistance surface layer formed thereon in the quenched state, it does not require an insulating coating. When a high squareness ratio is required, the core is annealed in a magnetic field oriented in parallel with its periphery. A magnetic field of a strength 10 times the coercive force of the alloy suffices. Where the crystallization onset temperature of the alloy is defined as Tx, the annealing temperature is set in the range of Tx −120° C. to Tx −20° C. and the annealing time at 30–120 minutes. If a high permeability is required, the magnetic field is applied perpendicularly to the core periphery. The annealing temperature and time in this case are substantially the same as those for obtaining a high squareness ratio. For achieving a high permeability it is also possible to adopt a method involving annealing at a temperature below the crystallization temperature and above the curie point, followed by water cooling.

From the foregoing description of the four aspects of the invention, it will be understood that the Sn-containing Fe—Si—B amorphous alloy magnetic ribbon according to the invention exhibits a high saturation magnetic flux density and retains its superior soft magnetic properties, specifically its low core loss and high permeability, even when used to produce wide and/or thick ribbon. In addition, the amount of variation in these magnetic properties is small both within one and the same lot and between different lots, and, moreover, the annealing conditions for the ribbon can be freely selected within a broad range. When applied to the cores of power transformers, saturable reactors and the like, the amorphous magnetic alloy according to the invention is therefore able to make a major contribution to reducing core size and core loss as well as to stabilizing the performance of the equipment concerned.

On the other hand, the tin-containing, Co-base, zero-magnetostriction amorphous magnetic alloy according to the invention not only exhibits excellent soft magnetic properties but also experiences only very slight deterioration of these properties after coating with a resin. The freedom in selecting annealing conditions is also broad. Because of these advantages, the Co base amorphous magnetic alloy containing Sn and Nb in combination in accordance with the invention enjoys a marked improvement in practical characteristics over the conventional Co base amorphous alloy.

The invention will now be explained with respect to working examples.

EXAMPLE 1

Mother alloys of the compositions shown in Table 1 were produced and 500 g of each was induction melted, whereafter the melt was passed through the slit-shaped aperture of a nozzle onto the outer periphery of a copper roll being rotated at a peripheral speed of 24 m/s to thus be quenched into a ribbon. A nozzle with a single slit measuring 0.4 mm in width and 25 mm in length was used.

The thickness of the ribbons obtained in this way and their amorphous property as determined by X-ray diffraction are shown in Table 1. Specimens taken from three different portions of each ribbon were fabricated into toroidal wound cores with an inner diameter of 60 mm. Each weighed 50 g. The wound cores were heat-treated in an argon atmosphere under a 10 Oe magnetic field oriented in the direction of the toroid periphery. As shown in Table 1, the heat treatment was carried out using a maximum temperature in the range of 260°–350° C. The maximum temperature was maintained for 25 minutes. The magnetic properties of the heat-treated specimens, specifically the core loss and the permeability, were measured using a B-H loop tracer and a wattmeter. The saturation magnetic density was also measured with a VSM (vibrating sample magnetometer). The measured values obtained for the properties and the heat-treatment conditions are shown in Table 1 together with those for comparative examples. Aside from the core loss, the values shown in Table 1 are the average for three specimens.

TABLE 1

| Specimen No. | Alloy composition (Atomic %) | Thickness (μm) | Amorphous Property | Annealing conditions (°C. × min) | Room temp. saturation magnetic flux density (Tesla) | Permeability B1 (Tesla) | Core loss (mW/kg) $W_{13/50}$ | Core loss (mW/kg) $W_{15/50}$ |
|---|---|---|---|---|---|---|---|---|
| | | | | Invention | | | | |
| 1 | $Fe_{85}Si_1B_{13.5}Sn_{0.5}$ | 25 ± 2 | G | 320 × 25 | 1.68 | 1.45 | 264, 260, 258 | 380, 373, 371 |
| 2 | $Fe_{84}Si_2B_{13.5}Sn_{0.5}$ | 28 ± 3 | G | 320 × 25 | 1.69 | 1.48 | 242, 243, 248 | 328, 343, 342 |
| 3 | $Fe_{84}Si_{3.1}B_{12}Sn_{0.9}$ | 28 ± 2 | G | 320 × 25 | 1.69 | 1.46 | 238, 241, 238 | 336, 347, 342 |
| 4 | $Fe_{83}Si_2B_{14.7}Sn_{0.3}$ | 30 ± 2 | G | 330 × 25 | 1.71 | 1.52 | 226, 223, 231 | 324, 323, 311 |
| 5 | $Fe_{83}Si_{4.7}B_{12}Sn_{0.3}$ | 29 ± 2 | G | 330 × 25 | 1.70 | 1.50 | 231, 233, 230 | 329, 330, 320 |
| 6 | $Fe_{83}Si_7B_{9.6}Sn_{0.4}$ | 29 ± 2 | G | 330 × 25 | 1.68 | 1.50 | 224, 223, 216 | 322, 318, 310 |
| 7 | $Fe_{82}Si_{5.9}B_{12}Sn_{0.1}$ | 30 ± 3 | G | 340 × 25 | 1.68 | 1.50 | 221, 222, 225 | 317, 324, 331 |
| 8 | $Fe_{82}Si_{4.3}B_{13}Sn_{0.7}$ | 30 ± 3 | G | 340 × 25 | 1.69 | 1.49 | 214, 212, 215 | 320, 328, 326 |
| 9 | $Fe_{82}Si_{3.8}B_{14}Sn_{0.2}$ | 31 ± 3 | G | 340 × 25 | 1.70 | 1.51 | 211, 210, 215 | 326, 321, 334 |
| 10 | $Fe_{82}Si_{8.5}B_9Sn_{0.5}$ | 30 ± 2 | G | 340 × 25 | 1.66 | 1.48 | 218, 221, 223 | 338, 343, 349 |
| 11 | $Fe_{81.5}Si_{5.2}B_{13}Sn_{0.3}$ | 30 ± 2 | G | 350 × 25 | 1.66 | 1.52 | 206, 203, 210 | 323, 326, 314 |
| 12 | $Fe_{81.5}Si_{9.2}B_9Sn_{0.3}$ | 31 ± 3 | G | 350 × 25 | 1.65 | 1.50 | 210, 209, 211 | 333, 330, 344 |
| 13 | $Fe_{81.2}Si_{10.6}B_8Sn_{0.2}$ | 29 ± 2 | G | 350 × 25 | 1.64 | 1.47 | 228, 218, 215 | 378, 364, 353 |
| | | | | Comparison | | | | |
| 1 | $Fe_{87}Si_3B_{10}$ | — | NR | — | — | — | — | — |
| 2 | $Fe_{85}Si_5B_{10}$ | — | NR | — | — | — | — | — |
| 3 | $Fe_{83}Si_5B_{12}$ | 28 ± 2 | F | 330 × 25 | 1.62 | 1.04 | 373, 394, 405 | 582, 640, 658 |
| 4 | $Fe_{81}Si_7B_{12}$ | 30 ± 2 | F | 350 × 25 | 1.62 | 1.12 | 262, 269, 312 | 408, 420, 507 |
| 5 | $Fe_{79}Si_9B_{12}$ | 30 ± 3 | G | 380 × 25 | 1.58 | 1.41 | 216, 204, 231 | 363, 330, 374 |
| 6 | $Fe_{78}Si_9B_{12}Sn_1$ | 28 ± 3 | G | 380 × 25 | 1.57 | 1.39 | 202, 216, 257 | 379, 389, 474 |
| 7 | $Fe_{77}Si_{9.5}B_{12}Sn_{0.5}$ | 28 ± 2 | G | 380 × 25 | 1.55 | 1.33 | 210, 202, 231 | 414, 394, 447 |
| 8 | $Fe_{82}Si_{3.97}B_{14}Sn_{0.03}$ | 28 ± 3 | F | 340 × 25 | 1.69 | 1.21 | 461, 469, 491 | 719, 732, 766 |

Legend:
G: Good
F: Fair
NR: No ribbon formed

As can be seen from Table 1, the conventional alloys with high Fe content (Fe>81 atomic %) are either incapable of forming a continuous ribbon or form a ribbon which is partially crystallized and poor in magnetic properties (core loss and permeability). In contrast, even when the alloy according to this invention is constituted as an Fe—Si—B amorphous alloy with an Fe content exceeding 81 atomic %, it does not reveal the presence of crystal phase under X-ray examination and exhibits excellent magnetic properties. For example, it exhibits a high saturation magnetic flux density of over around 1.63T and its core loss and permeability are on a par with those of a conventional low-Fe alloy (Fe<80 atomic %). Particularly notable is that the invention alloys exhibit a $W_{15/50}$ core loss property under high magnetic flux density that excels that of low-Fe alloys.

EXAMPLE 2

1.5 kg of each of the alloys whose compositions are shown in Table 2 was formed into an amorphous alloy ribbon.

In order to obtain ribbons of a thickness of 40 μm or more, the production was conducted by the multiple-slit method (using a double or triple slit nozzle with slits measuring 50 mm in length and 0.4 mm in width and spaced at 1 mm intervals). Otherwise the production conditions were the same as those in Example 1.

Figure 10A:
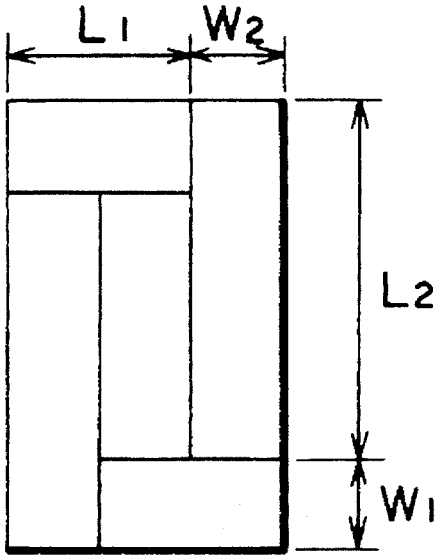
FIGS. 10(*a*) and 10(*b*) are diagrams showing the structure of a laminated iron transformer core according to an example of the invention, wherein (a) is a plan view and (b) is a view showing the lamination state at a joint portion.
Figure 10B:
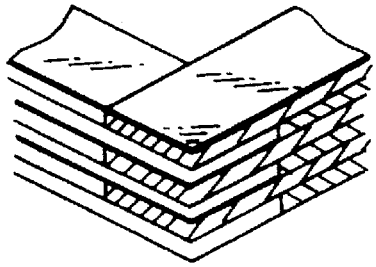

100 mm lengths and 200 mm lengths were cut from each amorphous ribbon, heat treated and then used to fabricate a laminated core with 90° joints, as shown in plan view in FIG. 10(*a*) and in the perspective view of a joint portion in FIG. 10(*b*). The sizes of these specimens were 100 mm length ($L_1$)×50 mm width ($W_1$), and 200 mm length ($L_2$)×50 mm width ($W_2$). Core fabrication was carried out by overlaying only a single cut section at a time. Upon completion, each core weighed 1 kg. The heat treatment was conducted in a nitrogen gas atmosphere with a 10 Oe magnetic field applied in the length direction of the specimen, at the temperature and for the time indicated in Table 2.The magnetic properties of the cores are also shown in Table 2.

amorphous magnetic alloys according to the present invention have a high saturation magnetic flux density and possess soft magnetic properties at high magnetic flux density that are on a level with those of prior art alloys. Owing to these features, and the fact that they can be fabricated into thick ribbons and thus enable enhanced space utilization, the invention alloys make a marked contribution to reduction of core size.

That is to say, since the amorphous magnetic alloys according to the invention are higher in saturation magnetic flux density than the prior art Fe—Si—B amorphous alloys and are also low in core loss, they are appropriate for use as the core material in power transformers, saturable reactors and other equipment requiring low core loss property. Their superiority over the prior art alloys increases with increasing Fe content and ribbon thickness.

TABLE 2

| Specimen No. | Alloy composition (Atomic %) | Thickness (μm) | Amorphous Property | Annealing conditions (°C. × min) | Room temp. saturation magnetic flux density (Tesla) | Permeability B1 (Tesla) | Core loss (mW/kg) $W_{13/50}$ | Core loss (mW/kg) $W_{15/50}$ |
|---|---|---|---|---|---|---|---|---|
| | | | | Invention | | | | |
| 14 | $Fe_{84}Si_{2.1}B_{13}Sn_{0.9}$ | 41 ± 4 | G | 320 × 25 | 1.68 | 1.52 | 242 | 392 |
| 15 | $Fe_{83.5}Si_2B_{14}Sn_{0.5}$ | 43 ± 3 | G | 330 × 25 | 1.69 | 1.53 | 223 | 352 |
| 16 | $Fe_{83}Si_{2.3}B_{14}Sn_{0.7}$ | 45 ± 3 | G | 330 × 25 | 1.70 | 1.55 | 201 | 289 |
| 17 | $Fe_{83}Si_{3.8}B_{13}Sn_{0.2}$ | 51 ± 4 | G | 330 × 25 | 1.69 | 1.53 | 208 | 299 |
| 18 | $Fe_{82.5}Si_5B_{12}Sn_{0.5}$ | 67 ± 5 | G | 340 × 25 | 1.67 | 1.53 | 205 | 292 |
| 19 | $Fe_{82}Si_{6.2}B_{11.5}Sn_{0.3}$ | 58 ± 5 | G | 340 × 25 | 1.67 | 1.52 | 194 | 279 |
| 20 | $Fe_{81.5}Si_9B_9Sn_{0.5}$ | 62 ± 3 | G | 350 × 25 | 1.65 | 1.52 | 211 | 329 |
| | | | | Comparison | | | | |
| 9 | $Fe_{84}Si_3B_{14}$ | NR | — | — | — | — | — | — |
| 10 | $Fe_{84}Si_{2.99}B_{13}Sn_{0.01}$ | NR | — | — | — | — | — | — |
| 11 | $Fe_{83}Si_3B_{14}$ | NR | — | — | — | — | — | — |
| 12 | $Fe_{83}Si_{2.99}B_{14}Sn_{0.02}$ | NR | — | — | — | — | — | — |
| 13 | $Fe_{50}Si_8B_{12}$ | 61 ± 5 | G | 360 × 25 | 1.60 | 1.49 | 196 | 318 |
| 14 | $Fe_{79}Si_8B_{13}$ | 60 ± 3 | G | 370 × 25 | 1.59 | 1.48 | 189 | 306 |
| 15 | $Fe_{78}Si_8B_{14}$ | 60 ± 4 | G | 380 × 25 | 1.57 | 1.43 | 171 | 298 |

Legend:
G: Good
NR: No ribbon formed

It can be seen from the data in Table 2 that the Sn-containing Fe—Si—B amorphous alloys according to the invention exhibit properties superior to those of conventional high-Fe amorphous alloys without added Sn also when fabricated into laminated cores.

When Sn was not added or was added to below the lower limit specified by the invention, it was impossible by the multiple-slit method to form thick ribbons (thickness of 40 μm or more) when the Fe content was 83 atomic % or more. With alloys having an Fe content below the lower limit according to the invention (Fe≦80 atomic %), while it was possible to form thick ribbon, the saturation magnetic flux density was below 1.63T, i.e. lower than the level aimed at by the invention.

It can also be seen from Table 2 that the alloys according to the invention are superior in core loss property at high magnetic flux density. This is because the effect of Sn addition increases in proportion as the Fe content rises and the ribbon thickness increases. In the prior art alloys core loss tends to increase sharply with increasing magnetic flux density so that at $W_{15/50}$ it deteriorates to or below the level of that of the invention alloys. This is because the prior art Fe—Si—B amorphous alloys are deliberately designed to lower the core loss to the vicinity of 1.3T. In contrast, the

EXAMPLE 3

Mother alloys of the compositions shown in Table 3 were produced and 500 g of each was induction melted, whereafter the melt was passed through the slit-shaped aperture of a nozzle onto the outer periphery of a copper roll being rotated at a peripheral speed of 24 m/s to thus be quenched into a ribbon. A nozzle with a single slit. The so-produced ribbons were all 25 mm wide and had the thicknesses shown in the thickness column of Table 3.

For determining the amorphous property of the ribbons, the free surface of each was analyzed by X-ray diffraction. A single strip tester was used to measure the magnetic properties of three samples taken from each ribbon. The items checked were the $W_{13/50}$ core loss at 50 Hz and 13T (tesla), the $W_{15/50}$ core loss at 50 Hz and 1.5T, and the flux density $B_1$ at 1 Oe (oersted). The size of the measured specimens was 25×120 mm and they were annealed in a magnetic field. Annealing conducted under conditions of a retention temperature of 260°–380° C. and a retention time of 10–60 minutes was found to provide optimum properties for the alloy compositions. The saturation magnetic density was also measured with a VSM (vibrating sample magnetometer).

The measured values obtained for the properties are shown in Table 4 together with those for comparative examples. Aside from those for the core loss, only the average values are shown.

TABLE 3

| Specimen No. | Alloy composition | Thickness (μm) | Amorphous property |
|---|---|---|---|
| | Invention | | |
| 21 | $Fe_{86}Si_2B_{11}C_{0.7}Sn_{0.3}$ | 22 ± 2 | G |
| 22 | $Fe_{85}Si_2B_{12}C_{0.5}Sn_{0.5}$ | 25 ± 3 | G |
| 23 | $Fe_{84}Si_2B_{12}C_{1.7}Sn_{0.3}$ | 26 ± 3 | G |
| 24 | $Fe_{83.5}Si_{25}B_{12}C_{1.7}Sn_{0.3}$ | 25 ± 2 | G |
| 25 | $Fe_{83}Si_2B_{13}C_{1.7}Sn_{0.3}$ | 24 ± 3 | G |
| 26 | $Fe_{83}Si_5B_9C_{2.5}Sn_{0.5}$ | 22 ± 2 | G |
| 27 | $Fe_{82.5}Si_{1.5}B_{14}C_{1.7}Sn_{0.3}$ | 27 ± 3 | G |
| 28 | $Fe_{82}Si_{2.7}B_{13}C_2Sn_{0.3}$ | 23 ± 2 | G |
| 29 | $Fe_{82}Si_6B_9C_{2.3}Sn_{0.7}$ | 22 ± 2 | G |
| 30 | $Fe_{81.5}Si_{5.2}B_{12}C_1Sn_{0.3}$ | 24 ± 3 | G |
| 31 | $Fe_{81}Si_{6.3}B_{12}C_1Sn_{0.2}$ | 25 ± 2 | G |
| 32 | $Fe_{81}Si_3B_{15}C_{0.7}Sn_{0.3}$ | 27 ± 3 | G |
| 33 | $Fe_{80.5}Si_{6.2}B_{12}C_1Sn_{0.3}$ | 27 ± 2 | G |
| 34 | $Fe_{80.5}Si_6B_9C_{3.3}Sn_{0.7}$ | 23 ± 3 | G |
| 35 | $Fe_{80}Si_{10}B_8C_{15}Sn_{0.5}$ | 20 ± 2 | G |
| | Comparison | | |
| 16 | $Fe_{86}Si_1B_{11}C_2$ | NR | — |
| 17 | $Fe_{86}Si_1B_{11}C_{1.98}Sn_{0.02}$ | NR | — |
| 18 | $Fe_{85}Si_1B_{12}C_2$ | NR | — |
| 19 | $Fe_{84}Si_2B_{12}C_2$ | 26 ± 2 | F |
| 20 | $Fe_{83}Si_5B_9C_3$ | 26 ± 2 | F |
| 21 | $Fe_{82.5}Si_{1.5}B_{14}C_2$ | 25 ± 2 | F |
| 22 | $Fe_{82}Si_2B_{13}C_2$ | 25 ± 2 | F |
| 23 | $Fe_{81}Si_5B_{12}C_2$ | 26 ± 2 | G |

Legend:
G: Good
F: Fair
NR: No ribbon formed

TABLE 4

| Specimen No. | Annealing conditions (°C. × min) | Saturation Flux Density (Tesla) | Permeability B1 (Tesla) | Core loss (mW/kg) $W_{13/50}$ | Core loss (mW/kg) $W_{15/50}$ |
|---|---|---|---|---|---|
| | | Invention | | | |
| 21 | 320 × 30 | 1.69 | 1.44 | 162, 158, 156 | 242, 236, 224 |
| 22 | 320 × 30 | 1.70 | 1.49 | 148, 153, 155 | 212, 215, 213 |
| 23 | 320 × 30 | 1.70 | 1.51 | 141, 140, 150 | 202, 202, 212 |
| 24 | 330 × 30 | 1.72 | 1.52 | 133, 136, 131 | 191, 196, 190 |
| 25 | 330 × 30 | 1.73 | 1.53 | 139, 137, 140 | 194, 193, 198 |
| 26 | 330 × 30 | 1.71 | 1.49 | 123, 122, 120 | 177, 173, 173 |
| 27 | 340 × 45 | 1.72 | 1.55 | 111, 113, 110 | 154, 156, 150 |
| 28 | 340 × 45 | 1.70 | 1.52 | 121, 116, 123 | 173, 170, 171 |
| 29 | 340 × 45 | 1.68 | 1.50 | 142, 138, 139 | 200, 196, 198 |
| 30 | 360 × 45 | 1.67 | 1.55 | 121, 122, 116 | 170, 171, 167 |
| 31 | 360 × 45 | 1.67 | 1.53 | 114, 112, 115 | 165, 163, 168 |
| 32 | 360 × 45 | 1.68 | 1.54 | 113, 118, 116 | 163, 172, 170 |
| 33 | 380 × 30 | 1.65 | 1.53 | 110, 108, 113 | 165, 163, 170 |
| 34 | 380 × 30 | 1.65 | 1.48 | 118, 118, 115 | 176, 178, 170 |
| 35 | 380 × 30 | 1.63 | 1.46 | 122, 120, 123 | 182, 178, 185 |
| | | Comparison | | | |
| 16 | — | — | — | — | — |
| 17 | — | — | — | — | — |
| 18 | — | — | — | — | — |
| 19 | 320 × 25 | 1.69 | 1.03 | 353, 374, 298 | 550, 583, 465 |
| 20 | 330 × 30 | 1.70 | 1.11 | 342, 338, 385 | 533, 527, 624 |
| 21 | 340 × 45 | 1.70 | 1.36 | 257, 303, 287 | 401, 472, 448 |
| 22 | 340 × 45 | 1.70 | 1.33 | 296, 313, 305 | 480, 507, 494 |
| 23 | 360 × 45 | 1.67 | 1.46 | 128, 122, 125 | 184, 175, 180 |

It is clear from Tables 3 and 4 that the Sn-containing Fe—Si—B—C amorphous magnetic alloys according to the invention are not only high in saturation magnetic flux density but are also characterized in having lower core loss than the comparison alloys having the same composition and thickness, in exhibiting high permeability, and in showing only small property scatter in terms of core loss and permeability.

EXAMPLE 4

One kilogram of each of the alloys whose compositions are shown in Table 5 was formed into an amorphous alloy ribbon measuring 25 mm in width. The ribbons were produced by the multiple-slit method (using a double or triple slit nozzle with slits measuring 0.4 mm in width and spaced at 1 mm intervals), in the same manner as described in connection with Example 1 except that the peripheral speed of the roll was 18 m/s.

The thickness and properties of the ribbons produced are shown in Tables 5 and 6.The specimen measurement conditions were similar to those in Example 3. The measured values obtained for the properties are shown in Table 6 together with those for comparative examples.

From Tables 5 and 6 it can be seen that the Sn-containing Fe—Si—B—C amorphous magnetic alloy according to the invention could be formed into an amorphous ribbon even at a thickness of 40 μm or greater. In contrast, the comparison alloys with no added Sn whose Fe content was 83 atomic % or more could not be formed into ribbons. Even at an Fe content of 82 atomic % or less, the Sn-containing alloys according to the invention exhibited higher permeability and lower core loss than the comparison alloys with the same Fe content. The superiority of the invention alloys in terms of core loss property was particularly notable when the measurement was conducted at a high flux density ($W_{15/50}$).

TABLE 5

| Specimen No. | Alloy composition (Atomic %) | Thickness (μm) | Amorphous property |
|---|---|---|---|
| | Invention | | |
| 36 | $Fe_{84}Si_2B_{12}C_{1.7}Sn_{0.3}$ | 41 ± 2 | G |
| 37 | $Fe_{83}Si_2B_{13}C_{1.7}Sn_{0.3}$ | 42 ± 3 | G |
| 38 | $Fe_{82.5}Si_2B_{14}C_1Sn_{0.5}$ | 56 ± 3 | G |
| 39 | $Fe_{82}Si_2B_{13}C_{2.5}Sn_{0.5}$ | 56 ± 3 | G |
| 40 | $Fe_{81.5}Si_{5.2}B_{12}C_1Sn_{0.3}$ | 53 ± 2 | G |
| 41 | $Fe_{81}Si_8B_9C_{1.7}Si_{0.3}$ | 62 ± 3 | G |
| 42 | $Fe_{80.5}Si_{9.5}B_{8.7}C_1Si_{0.3}$ | 65 ± 3 | G |
| | Comparison | | |
| 24 | $Fe_{86}Si_1B_{11}C_2$ | NR | — |
| 25 | $Fe_{86}Si_1B_{11}C_{1.98}Sn_{0.02}$ | NR | — |
| 26 | $Fe_{85}Si_1B_{12}C_2$ | NR | — |
| 27 | $Fe_{84}Si_3B_{12}C_1$ | NR | — |
| 28 | $Fe_{83}Si_5B_9C_5$ | NR | — |
| 29 | $Fe_{82}Si_8B_9C_1$ | 50 | F |
| 30 | $Fe_{81}Si_{9.5}B_{8.5}C_1$ | 50 | F |

Legend:
G: Good
F: Fair
NR: No ribbon formed

TABLE 6

| Specimen No. | Annealing conditions (°C. × min) | Saturation Flux Density (Tesla) | Permeability B1 (Tesla) | Core loss (mW/kg) $W_{13/50}$ | Core loss (mW/kg) $W_{15/50}$ |
|---|---|---|---|---|---|
| | | Invention | | | |
| 36 | 320 × 25 | 1.70 | 1.46 | 258 | 371 |
| 37 | 330 × 30 | 1.73 | 1.55 | 226 | 325 |
| 38 | 340 × 45 | 1.72 | 1.54 | 220 | 309 |
| 39 | 340 × 45 | 1.70 | 1.55 | 216 | 298 |
| 40 | 360 × 45 | 1.67 | 1.55 | 197 | 283 |
| 41 | 360 × 45 | 1.68 | 1.53 | 186 | 272 |
| 42 | 380 × 30 | 1.65 | 1.52 | 183 | 263 |
| | | Comparison | | | |
| 24 | — | — | — | — | — |
| 25 | — | — | — | — | — |
| 26 | — | — | — | — | — |
| 27 | — | — | — | — | — |
| 28 | — | — | — | — | — |
| 29 | 340 × 45 | 1.68 | 1.16 | 316 | 512 |
| 30 | 360 × 45 | 1.66 | 1.25 | 237 | 357 |

EXAMPLE 5

Mother alloys obtained by adding 0.05, 0.1, 0.3 and 0.5 weight % of Sn to an $Fe_{84}Si_2B_{14}$ (atomic %) alloy were induction melted, whereafter each melt was passed through a slit nozzle onto a copper roll to thus be quenched into a long ribbon measuring 25 mm in width. Upon examination by X-ray diffraction it was found that the ribbons exhibited the halo peculiar to amorphous materials. The surface of each ribbon was analyzed by GDS. The state of Sn segregation on the free surface is shown in Table 7. In each alloy tin segregation was observed in a shallow layer lying no more than 0.02 μm below the surface and the peak concentration of Sn in this layer was 10 or more times that at the ribbon interior. Moreover the peak half-value width, namely the thickness of the segregation layer, was between about 0.003 μm and 0.01 μm in the case of ribbons with a single peak and between about 0.01 μm and 0.02 μm in the case of ribbons with double peaks.

After the aforesaid amorphous ribbons according to the invention had been annealed in a nitrogen atmosphere in the presence of a magnetic field, they were once again examined by X-ray diffraction. All of the ribbons were found to found to have retained their amorphous state. The annealed ribbons were subjected to magnetic property measurement using a single strip tester. The results are shown in Table 7.The values of the core loss at 50 Hz, 1.3T ($W_{13/50}$) and the permeability ($B_1$) at 1 Oe were of a superior level, fully adequate for enabling the ribbons to be used in the fabrication of power transformer cores.

In contrast, the comparison alloys having the same composition as the invention alloys but with no added tin and the comparison alloys with a tin content outside the range specified by the invention showed very little or no Sn segregation when measured by GDS. Moreover, when examined by X-ray diffraction after annealing at 320° C. for 60 minutes, they were found to have crystallized at the free surface. As shown in Table 7, the magnetic properties of the comparison alloys were much poorer than the amorphous magnetic ribbons with Sn segregation layer according to the invention.

TABLE 7

| Sn addition (Weight %) | Sn Segregation layer (GDS) Peak position (μm) | Peak value (vs bulk) | Layer thickness (μm) | Core loss ($W_{13/50}$) (W/kg) | Permeability (B1) (Tesla) |
|---|---|---|---|---|---|
| 0.005 | 0.005 | 12 | 0.005 | 0.140 | 1.43 |
| 0.1 | 0.007 | 15 | 0.006 | 0.132 | 1.46 |
| 0.3 | 0.005, 0.008 | 11, 16 | 0.009 | 0.126 | 1.48 |
| 0.5 | 0.005, 0.014 | 8, 12 | 0.016 | 0.122 | 1.50 |
| No tin added; no peak | | — | — | 0.233 | 0.93 |

Two peaks appeared at each of Sn 0.3% and 0.5%. Both values are given for each.?

EXAMPLE 6

Mother alloys obtained by adding prescribed amounts of Sn to alloys having the compositions shown in Table 8 were used for producing ribbons by the same method as in Example 5.The condition of the Sn segregation layer formed on the free surface of the as-cast ribbons was as shown in Table 8. Edging was carried out with respect to some of the alloys. This is noted in the remark column of Table 9. Each ribbon was heat treated in a nitrogen atmosphere for 60 minutes at a temperature 60° C. lower than its crystallization onset temperature (Tx). The results are shown in Table 9. All of the ribbons exhibited a halo pattern in free-surface X-ray examination, indicating that they had not crystallized.

In contrast, the comparison alloys having the same composition but with no Sn segregation layer were found to crystallize when annealed under the same conditions.

TABLE 8

| Specimen No. | Above: Basic comp. (atomic %) Below: Sn addition | Sn segregation layer (GDS) Peak position (μm) | Peak value (vs bulk) | Layer thickness (μm) |
|---|---|---|---|---|
| 43a | $Fe_{76}Co_8Si_4B_{12}$ | No Sn peak | | |
| 43b | +0.3 wt % Sn | 0.004, 0.008 | 12, 16 | 0.008 |
| 44a | $Fe_{80}Mo_2Si_4B_{14}$ | No Sn peak | | |
| 44b | +0.1 wt % Sn | 0.007 | 14 | 0.005 |
| 45a | $Fe_{80}Nb_2Si_4B_{14}$ | No Sn peak | | |
| 45b | +0.01 wt % Sn | 0.006 | 15 | 0.01 |
| 46a | $Fe_{78}Ni_6Si_2B_{14}$ | No Sn peak | | |
| 46b | +0.05 wt % Sn | 0.005 | 14 | 0.005 |
| 47a | $Fe_{80}Ta_2Si_3B_{15}$ | No Sn peak | | |
| 47b | +0.05 wt % Sn | 0.006 | 13 | 0.006 |
| 48a | $Fe_{80}W_3Si_3B_{15}$ | No Sn peak | | |
| 48b | +0.3 wt % Sn | 0.006, 0.007 | 15, 20 | 0.01 |
| 49a | $Fe_{78}Cr_4Si_8B_{10}$ | No Sn peak | | |
| 49b | +0.02 wt % Sn | 0.010 | 20 | 0.015 |
| 50a | $Fe_{80}V_4Si_2B_{14}$ | No Sn peak | | |
| 50b | +0.6 wt % Sn | 0.005, 0.016 | 10, 15 | 0.022 |
| 51a | $Fe_{82}Cu_2Si_4B_{12}$ | No Sn peak | | |
| 51b | +0.9 wt % Sn | 0.005, 0,020 | 6, 8 | 0.028 |
| 52a | $Fe_{82}Si_2B_{14}C_2$ | No Sn peak | | |
| 52b | +0.2 wt % Sn | 0.008 | 17 | 0.007 |
| 53a | $Fe_{76}Mn_2Si_{14}B_8$ | No Sn peak | | |
| 53b | +0.5 wt % Sn | 0.005, 0.011 | 6, 11 | 0.015 |

43a, 44a . . . are comparative examples consisting only of the basic composition.
43b, 44b . . . are embodiments of the invention with the same basic composition and added with Sn.

TABLE 9

| Specimen No. | Amorphous property after annealing | Remark |
|---|---|---|
| 43a | Crystalline | |
| 43b | Amorphous | 2 peaks |
| 44a | Partially crystalline | |
| 44b | Amorphous | |
| 45a | Partially crystalline | |
| 45b | Amorphous | Edging |
| 46a | Crystalline | |
| 46b | Amorphous | |
| 47a | Partially crystalline | |
| 47b | Amorphous | |
| 48a | Partially crystalline | |
| 48b | Amorphous | 2 peaks |
| 49a | Crystalline | |
| 49b | Amorphous | Edging |
| 50a | Crystalline | |
| 50b | Amorphous | 2 peaks |
| 51a | Crystalline | |
| 51b | Amorphous | 2 peaks |
| 52a | Crystalline | |

TABLE 9-continued

| Specimen No. | Amorphous property after annealing | Remark |
|---|---|---|
| 52b | Amorphous | |
| 53a | Crystalline | |
| 53b | Amorphous | 2 peaks |

43a, 44a . . . are comparative examples consisting only of the basic composition.
43b, 44b . . . are embodiments of the invention, namely alloy ribbons with the same basic composition as their –a partners but added with Sn.

EXAMPLE 7

Ribbons of alloys with a composition of $(Co_{68.2}Fe_{3.8}Si_{17}B_9Nb_2)_{100-x}Sn_x$ in which x was 0.1, 0.2, 0.5 and 1.0 were produced by the single roll quenching method, to a width of 5 mm and a thickness of 15–20 μm. The amorphous state of the ribbons was confirmed by X-ray diffraction.

Each ribbon was fabricated into to toroidal core with an inner diameter of 14 mm and an outer diameter of 21 mm and then annealed in a stream of $N_2$ under a direct current magnetic field of about 1 Oe. The annealing was conducted at a retention time of 1 hour and the temperature was varied as a parameter between 400°–540° C. For evaluating the practicality of the annealed cores, their magnetic properties were measured before and after coating with resin. More specifically, magnetic properties were measured both with respect to as-annealed cores inserted into resin cases and wound with wire and with respect to cores that were coated with resin and then wound with wire.

Table 10 shows the magnetic properties obtained when the alloys according to the invention were annealed under optimum conditions. For comparison, Table 10 also shows the properties of non-invention alloys not containing the amount of Sn prescribed by the invention. As can be seen from the table, the encased alloys according to the invention exhibited excellent magnetic properties (squareness ration>0.95, coercive force<200 mOe) and also retained these properties with no substantial change after coating. In contrast, it will be noted that the alloys with no added tin and the alloys with a tin content outside the range specified by the invention either did not exhibit adequate properties as housed in resin cases (squareness ratio<0.95 or coercive force>200 mOe) or if they did, their properties were heavily degraded after resin coating, to such an extent that they were unable to achieve the property values set by the invention.

It can further be seen that the alloys according to the invention exhibit stable properties over a wide range of annealing temperatures, while their properties after resin coating also enable a high degree of freedom in selecting the annealing conditions.

TABLE 10

| | | Before resin coating | | After resin coating | |
|---|---|---|---|---|---|
| | Thickness (μm) | Squareness ratio (%) | Coercive force (mOe) | Squareness ratio (%) | Coercive force (mOe) |
| | | Invention | | | |
| $(Co_{68.2}Fe_{3.8}Si_{17}B_9Nb_2)_{100-x}Sn_x$ | | | | | |
| x = 0.1 | 15.0 | 98.5 | 147 | 98.3 | 143 |
| 0.2 | 16.7 | 98.7 | 143 | 98.3 | 138 |
| 0.5 | 16.3 | 97.8 | 125 | 97.5 | 132 |
| 1.0 | 17.7 | 98.1 | 112 | 97.8 | 121 |
| | | Comparison | | | |
| $Co_{70}Fe_5Si_{15}B_{10}$ | 15.8 | 92.2 | 276 | 82.0 | 411 |
| $Co_{68.2}Fe_{3.8}Si_{17}B_9Nb_2$ | 16.5 | 96.5 | 193 | 93.7 | 305 |
| $Co_{70.5}Fe_{4.5}Cr_2Si_{10}B_{13}$ | 17.2 | 97.6 | 178 | 93.8 | 330 |
| $Co_{70}Fe_{4.5}V_2Si_{10}B_{13.3}$ | 15.6 | 95.3 | 167 | 87.5 | 235 |

Measurement conditions: 100 kHz
Magnetic field-20 mOe max

TABLE 11

| Composition | Thickness (μm) | Initial permeability before resin coating | Initial permeability after resin coating |
|---|---|---|---|
| | Invention | | |
| $(Co_{68.2}Fe_{3.8}Si_{17}B_9Nb_2)_{100-x}Sn_x$ | | | |
| x = 0.1 | 16.3 | 33,300 | 28,200 |
| 0.2 | 15.0 | 32,000 | 28,900 |
| 0.5 | 15.7 | 33,000 | 29,000 |
| 1.0 | 16.5 | 31,500 | 27,000 |
| | Comparison | | |
| $Co_{70}Fe_5Si_{15}B_{10}$ | 18.2 | 32,300 | 19,000 |
| $C_{68.2}Fe_{3.8}Si_{17}B_9Nb_2$ | 16.3 | 21,300 | 13,500 |
| $Co_{70.5}Fe_{4.5}Cr_2Si_{10}B_{13}$ | 17.5 | 28,300 | 18,500 |
| $Co_{70}Fe_{4.5}V_2Si_{10}B_{13.5}$ | 19.0 | 26,100 | 16,300 |

Measurement conditions: 100 kHz
Magnetic field-5 mOe

EXAMPLE 8

Toroidal coils fabricated from the same kind of amorphous alloy ribbons as in Example 7 were annealed under application of a magnetic field perpendicularly to their lengthwise direction. Their initial permeability in encased state and after coating with resin is shown in Table 11. As can be seen from this table, the alloys according to the invention exhibited excellent initial permeability as encased and, moreover, also experienced less degradation by resin coating than did the comparison alloys.

What is claimed is:

1. An amorphous magnetic alloy that has a composition represented by $Fe_aSi_bB_cSn_x$, where $82<a\leqq 86$, $1.5\leqq b\leqq 12$, $6\leqq c\leqq 16$, $0.05\leqq x\leqq 1$ (atomic %) and a+b+c+x=100, and comprises one side that has been contacted by a cooling roll and a second side that has been free of such contact by a cooling roll, and an Sn segregation layer that is formed on the second side.

2. An amorphous magnetic alloy ribbon of a composition represented by $M_aX_bSi_cB_dC_eSn$, where M is at least one of Fe and Ni, X is at least one of Mo, Nb, Ta, W, Cr, V, Mn and Cu, b=0–6, c=1.5–19, d=7–20, e=0.5–4 (atomic %) and a+b+c+d+e=100, and containing 0.01–1.0 weight % Sn, comprising one side that has been contacted by a cooling roll and a second side that has been free of such contact by a cooling roll, and an Sn segregation layer formed on the second side that has a thickness of not more than 0.03 μm and is located at a depth of not more than 0.1 μ, the peak value of the Sn concentration of the segregation layer being not less than five times that of the ribbon bulk.

* * * * *